United States Patent [19]

Pryor et al.

[11] 4,173,238

[45] Nov. 6, 1979

[54] TRIMMER METHODS AND APPARATUS FOR SAWMILLS

[76] Inventors: Roy R. Pryor; Harold A. Pryor, both of P.O. Box 26, Woodville, Tex. 75979

[21] Appl. No.: 747,436

[22] Filed: Dec. 6, 1976

[51] Int. Cl.[2] ..... B26D 7/06; B27B 7/00

[52] U.S. Cl. ..... 144/312; 83/23; 83/367; 83/418; 83/423; 83/471.2; 83/436; 83/490; 83/491; 144/245 D; 144/246 R; 198/412

[58] Field of Search ..... 144/2 R, 3 R, 242 R, 144/242 D, 245 R, 245 A, 245 F, 312, 245 D; 83/23, 56, 367, 418, 421, 416, 423, 435.2, 436, 491, 425.1; 198/411, 412, 413, 485, 614, 402, 403, 366, 370

[56] References Cited

U.S. PATENT DOCUMENTS

| | | | |
|---|---|---|---|
| 1,487,649 | 3/1924 | Foreman | 144/312 X |
| 2,253,453 | 8/1941 | Van Deinse | 83/407 |
| 2,273,653 | 2/1942 | Melby | 144/39 X |
| 2,403,673 | 7/1946 | Mead | 83/368 X |
| 2,527,024 | 10/1950 | Mitchell | 83/418 X |
| 2,918,951 | 12/1959 | Haumann | 144/246 G X |
| 3,802,474 | 4/1974 | Fell | 83/490 X |
| 3,985,055 | 10/1976 | Cornell | 83/418 X |
| 4,031,788 | 6/1977 | Boge et al. | 83/490 X |

FOREIGN PATENT DOCUMENTS

| | | | |
|---|---|---|---|
| 257771 | 2/1965 | Australia | 144/312 |

*Primary Examiner*—Robert Louis Spruill
*Assistant Examiner*—W. D. Bray
*Attorney, Agent, or Firm*—Bard & Groves

[57] ABSTRACT

An improved trimmer section is provided for use in a sawmill, together with method and means for automatically selecting timbers and the like to be trimmed, and for automatically routing trimmed timbers to a preselected one of a plurality of different storage and loading points in the sawmill. In particular, the operator is required to select which of several stations is to receive each timber after it has been cut to a designated length. Thereupon, the timber is automatically transferred through several stages of mechanical manipulation to the designated station while, simultaneously therewith, another un-trimmed timber is promptly conducted to the trimming saws. Actuation of the entire operation is effected by merely selecting the station to receive the trimmed timber, since the cycle will repeat as long as there are timbers to be trimmed.

23 Claims, 19 Drawing Figures

FROM FIG. 10A 233K
233M
233L
237P
246
SELECTION CONTROL
240
240C
234A
237P
241B
103A
237J
103A
237J
240C
235A
242A
149
242A
233L
148
148A
242D
242D
242H
242H
139
139A
235A
138
145
146A
234A
236
140
141
234A
142
235A
144
143
158
157
242
242A
146A
TO FIG. 10F

FROM FIG. 10C
233E
237P
103A
241B
239H
237M
233J
119A
226H
237J
245
122
118
227
121
128
228
129
126
228J
173
230
229
175
103A
239H
237P
241B
228J
245
237J
TO FIG. 10E

FROM FIG. 10D
103A
239H
237P
241B
228J
245
237J
127
131
231
177
130
150
193
132
179
232
133
233
103A
239H
241B
237P
245
237J
TO FIG. 10F

FROM FIG. 10E

FROM FIG. 10B
237P
103A
241B
245
237J
242D
239H
234A
181
234A
234
237P
241B
103A
103A
237J
240C
235A
183
235A
242A
235
233L
240C
237J
148A
103A
240C
242D
238
242H
242H
185
139A
237J
146A
154
155
245
146A
103A
239
146
195
147
239H
239H
197

309
313
310
304A
304C
304E
241A
304
305
305B
305D
305F
305H
304H
241FF
241B
305M
146A
300A
FROM CIRCUIT 146A
103A
304H
241F
303A
300
301
302
303
301A
302A
TO FIG. 11B

311
C
314
312
304A
304C
304E
241A
306
305H
305F
305D
305B
307
241FF
241B
305M
FROM SWITCH 149
303A
304H
103A
146A
241F
103A
241F
241B
(TO RELAY 237)
308
301A
302A
241
103A
300A
241A
FROM FIG. 11A
NO. 1 - 4 TIMBER DECKS
146A
(FROM RELAY 240)

TRIMMER METHODS AND APPARATUS FOR SAWMILLS

BACKGROUND OF INVENTION

This invention relates to improved sawmill methods and apparatus, and more particularly relates to improved methods and apparatus for cross-cutting the ends from sawlog slices to produce lumber, railroad ties and the like, cut to a predetermined length. More specifically, this invention further relates to a self-contained trimmer section for a fully automated sawmill.

It is well known that trees are grown and harvested to produce sawlogs, and it is also well known that these sawlogs are carried to sawmills where they are sliced into boards, timbers, railroad ties, and other forms of wood stock. In Applicants' U.S. Pat. No. 3,943,808, which issued Mar. 16, 1976, there is described and depicted a complete sawmill incorporating certain novel concepts including, but not limited to, a modular-type construction wherein each section of the mill is constructed so as to be structurally and functionally independent of the other sections, but wherein such sections can be quickly and easily joined together to produce a functionally integrated sawmill. As will hereinafter be explained in detail, a sawmill of this type is not only cheaper and easier to erect, it can also be disassembled and then re-erected at a different location. In addition, however, the operation of these sections can be easily integrated whereby automation of such a sawmill can be achieved.

Referring more particularly to the modular sawmill described in the aforementioned U.S. Pat. No. 3,943,808, it may be seen that a unique feature is a platform which is constructed of a plurality of scheduled piers, longerons and other prefabricated pieces to provide a unitary supporting structure having three functional levels. Thus, the modular sawmill may, after the platform has been erected, be assembled merely by depositing and by thereafter connecting the various sections together by means of appropriate electrical cables and pneumatic conduits, whereby the various sections are transformed into an integrated operating assembly as hereinbefore stated.

As also previously stated, since the various component sections of the mill are structurally independent of each other, they can be prefabricated and only thereafter carried to the millsite. Accordingly, most of the time required to erect such a sawmill will be spent in building the platform, since only a minimal period is required to position the modules or sections onto the platform and to thereafter cable them together into a functional unit.

As is more fully set forth in the aforementioned U.S. Pat. No. 3,943,808, the trimmer section of a sawmill conventionally performs its function intermediate of the originally slicing function and the disposition of the fully cut pieces to a location where they are held for loading onto trucks and the like. In an automated sawmill, therefore, the trimmer section performs an intermediate function which must be fully coordinated with functions performed both prior and subsequent thereto.

In accordance with the principles set forth for achieving the advantages of the modular concept, a trimmer section is hereinafter provided which automatically receives timbers and other partially cut pieces carried thereto, arranges and conducts such pieces to a location immediately preceding the trimming saws, selects and conducts each such piece individually to the trimming saws, cuts such pieces to a predetermined length or lengths, and thereafter discharges such trimmed pieces to other handling equipment which then transports them to one of a preselected holding locations.

In further consistency with the principles of a modular sawmill, the trimmer section incorporating the concepts of the present invention is structurally independent of the other sections of the sawmill, and is also adapted to be installed on the aforementioned platform for compatability with such other sections. On the other hand, and in further consistency with the aforementioned principles of the modular-type sawmill, the trimmer section embodying the present invention may either be operated independently of the other sections of the sawmill, or it may be functionally integrated with such components to produce a sawmill which is automated to a high degree.

PREFERRED EMBODIMENT

In a preferred embodiment of the present invention, a trimmer deck assembly is provided which is adapted to be disposed on a platform of a modular-type sawmill at a right angle to a roller bed assembly leading from the slicing saw. A pair of drag-off arms are disposed at the receiving end of the trimmer deck, for extension across the first roller bed section, and are further responsive to actuation of a stop assembly in such roller bed section. Accordingly, whenever a sawlog slice travels longitudinally down the roller bed section to impact against the stop assembly, the two drag-off arms are then energized by the stop assembly to laterally shift the slice from the roller bed section onto and across the chains of the trimmer deck.

Each time a sawlog slice is shifted onto the receiving end of the trimmer deck, it tends to abut and shift one or more prior slices laterally along the chains a distance corresponding to the width of the last received slice. Accordingly, one of such slices will eventually be shifted onto a pad-type actuating switch which, when depressed by the weight of such slice, actuates a motor to travel the chains to carry all slices then on the deck towards its opposite end. Eventually, therefore, the trimmer deck becomes a repository for a plurality of sawlog slices each extending laterally across the deck and resting on the movable chains running along its edges.

The slices will usually be rectangular in cross section, rather than square, and for reasons which will hereinafter be apparent, it is desirable that the slices not stand on end on the trimmer deck. Accordingly, a pendulum-actuated switch is disposed over the trimmer deck, at a height whereby it will only be actuated by a slice which is then standing on end. When this happens, however, a flipper mechanism is energized which, striking upward from below the trimmer deck, flips the incorrectly positioned slice over onto its side.

A rotator mechanism, which is located at the discharge end of the trimmer deck, is composed of a pair of notched, semi-circular members mounted on the ends of a rotatable shaft. Thus, the chains of the trimmer deck may be traveled to carry the first received sawlog slice to the opposite end of the deck and into the notches in the two moon members. When such members are thereafter rotated, the sawlog slice inserted therein will then be lifted arcuately over and onto a second pair of arms constructed substantially the same as the aforementioned drag-off arms which, in turn, are actuated to shift the slice forward and onto a third pair of such arms.

It is the purpose of such third pair of drag-off arms to move the slice or timber into position to be cut to a predetermined length by a pair of spaced-apart circular saw blades. The timber must be secured against movement during this step in the operation, however, and thus the timber is preferably drawn by such third pair of drag-off arms laterally into wedging engagement with a pair of uplifted stop members which, when the trimming step has been performed, are operable to shift the trimmed slice or timber onto a second roller bed section leading to whichever storage or collection point has been preselected to receive the timber.

As will hereinafter be explained in detail, the various actuating mechanisms for performing these various steps may be selectively and independently operated as desired, or they may be interconnected and interrelated to function according to a predetermined sequence. It will be readily apparent to those having experience with material handling operations, however, that a large elongate body is such that it may not easily be conducted mechanically from one place to another, especially if it must be transferred both laterally and longitudinally during its course of travel. This is especially true in the case of sawmill operations, since the boards, timbers and other pieces cut from a sawlog are not only relatively massive, but they also will have a variety of different sizes and lengths. Thus, whenever a heavy timber or the like becomes mispositioned along its course of travel, there is an immediately likelihood that succeeding timbers will drive it further awry to create a jam in the operations unless it can be immediately restored to a proper position.

Another problem with operations of this type is that the timbers must not only be shifted both laterally and longitudinally, provision must also be made to shift these pieces rotatably a about their longitudinal axis. As may be seen in the aforementioned U.S. Pat. No. 3,943,808 whenever a piece is sliced off of the sawlog, it tends to fall laterally onto its flat side and onto the first mentioned roller bed assembly or other conveyor section which, in turn, then carries it longitudinally to the receiving end of the trimmer deck assembly. As also hereinbefore stated, the rotator assembly at the discharge end of the trimmer deck, however, picks up and stands each piece on its edge since this is the preferred position for cutting its ends with the two trimming saws. It will be apparent, therefore, that each piece be transferred onto the trimmer deck while lying on its broader side, else the rotator will misposition the piece when it is moved to the trimming saws.

To provide against such a contingency, there is preferably provided a shifting or "flipping" mechanism which automatically examines each piece received onto the trimmer deck and, whenever a piece is found to be standing on its narrower side, rotates or "flips" it over before permitting it to proceed to the rotator. In its preferred form, the flipper will include a serrate or tooth-like member which, upon actuation, rises vertically to catch and lift the lower leading edge of the timber and thereby flip it backward and onto its flat side. The "examining" function may be performed by any convenient device, such as by a beam of light which, when broken by an abnormally tall piece, closes a circuit to the flipper. As will hereinafter be described in detail, however, a particularly suitable examining device is a lever which is danglingly suspended above the trimmer deck and above properly positioned timbers thereon. Whenever an improperly positioned piece strikes and moves this lever, however, it is deflected to close a switch to actuate the flipper.

SUMMARY OF THE INVENTION

In its broader concept, the present invention may be stated to be an improved trimmer section which, in conjunction with the other sections of the sawmill of which it is a part, not only performs its expected function of cutting a board or timber to a preselected length, but which also controls the overall operating sequence of the entire sawmill by selecting the timber to be trimmed and by then routing the trimmed pieces to appropriate receiving points. More particularly, the automated operating sequence may logically be said to begin at the point when a timber has been locked into the trimmer saw section in preparation for trimming. The sawmill operator then initiates the sequence by selecting a particular one of a plurality of different receiving points or locations. When this is done (by actuating the appropriate control), the trimmer saw section will then cut the ends of the timber to provide it with the proper length, and will thereafter transfer the trimmed piece laterally onto a conveyor which, upon receiving the piece, then carries it to and places it on the timber deck designated as the selected receiving location. Coincident with the transfer of the trimmed piece to the conveyor, however, the trimmer saw section also selects and positions the next succeeding untrimmed timber with respect to the trimmer section. This, in turn, allows the trimmer deck to present the next succeeding one of a supply of untrimmed timbers to the trimmer saw section, and also to replenish such supply by taking a replacement piece from the conveyor section extending betwen the main saw section and the trimmer deck assembly. This, in turn, permits this conveyor to conduct another piece to the trimmer deck assembly.

As will hereinafter be explained in detail, the overall trimmer section may be said to have two alternative modes of operation, i.e., the "manual" mode wherein its various operating components may be selectively actuated by the sawmill operator, and the "automatic" mode wherein the components are actuated according to a predetermined sequence as previously described. More particularly, however, the trimmer deck assembly actually has only one "automatic" mode of operation, except that its rotator portion may be selectively controlled and actuated by the operator. Alternatively, it is the trimmer saw assembly which actually has two distinctly different modes of operation. Even then, however, the trimmer saws are manually controlled by the operator in both modes, and the operator must always manually select the storage deck which is to be the destination for each timber moving through the trimmer section.

These and other features and advantages of the present invention will become apparent from the following detailed description, wherein reference is made to the figures in the accompanying drawings.

IN THE DRAWINGS

FIG. 1 is a simplified pictorial representation of an overhead view of one embodiment of the present invention, wherein there may be seen a novel trimmer deck assembly arranged and adapted to receive timbers and the like from a roller bed assembly, and a trimmer saw assembly arranged and adapted to receive such timbers from the deck assembly and, after cutting them to a preselected length, transfer them to a second roller bed assembly.

FIGS. 9 A–C present a simplified schematic diagram of one form of pneumatic circuitry for operating the apparatus depicted in FIGS. 1–8.

FIGS. 10 A–F present a simplified schematic diagram of one form of electro-mechanical circuitry for operating the systems and mechanisms depicted in FIGS. 1–9.

Figure 10A:
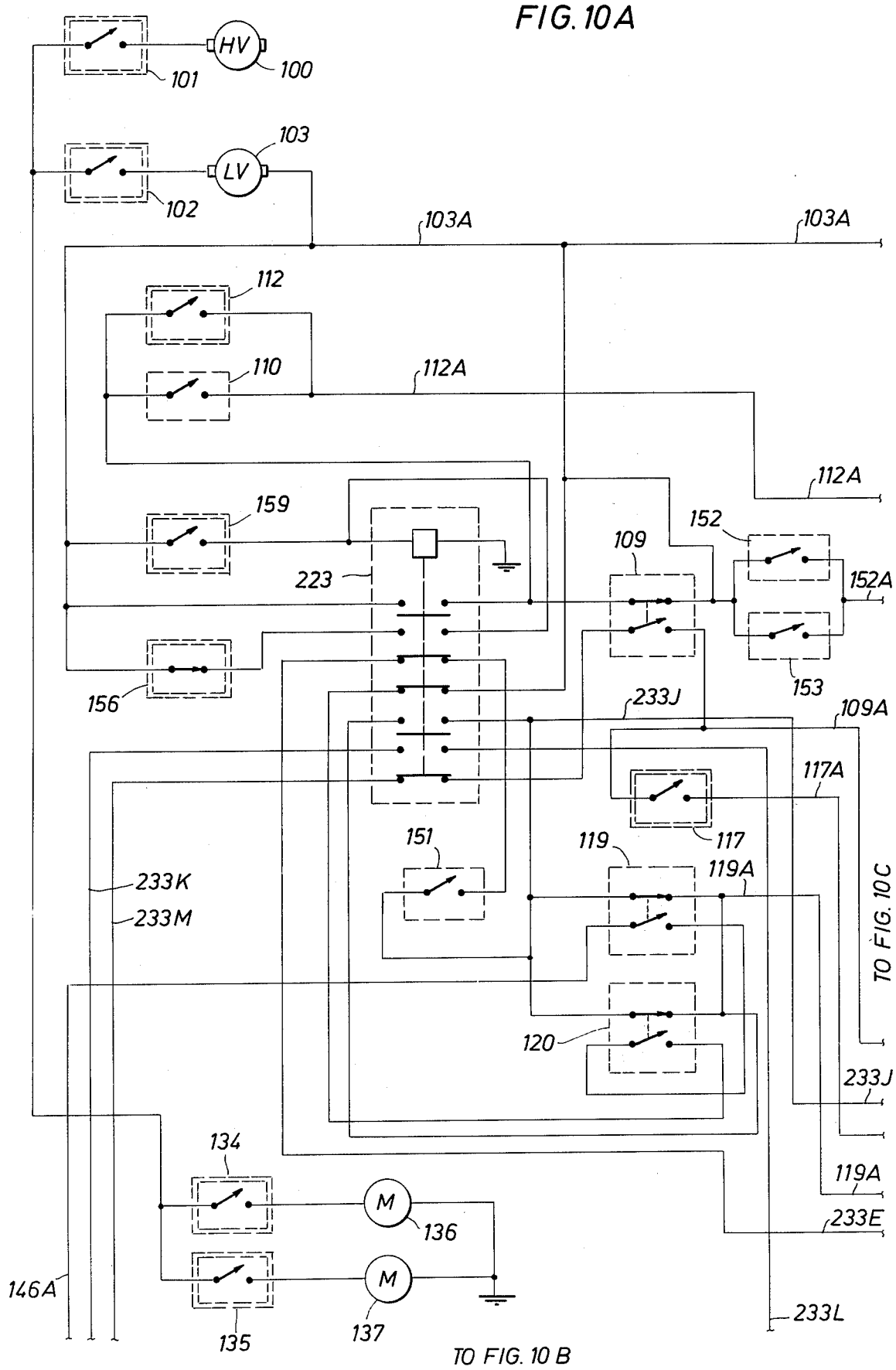
Figure 10B:
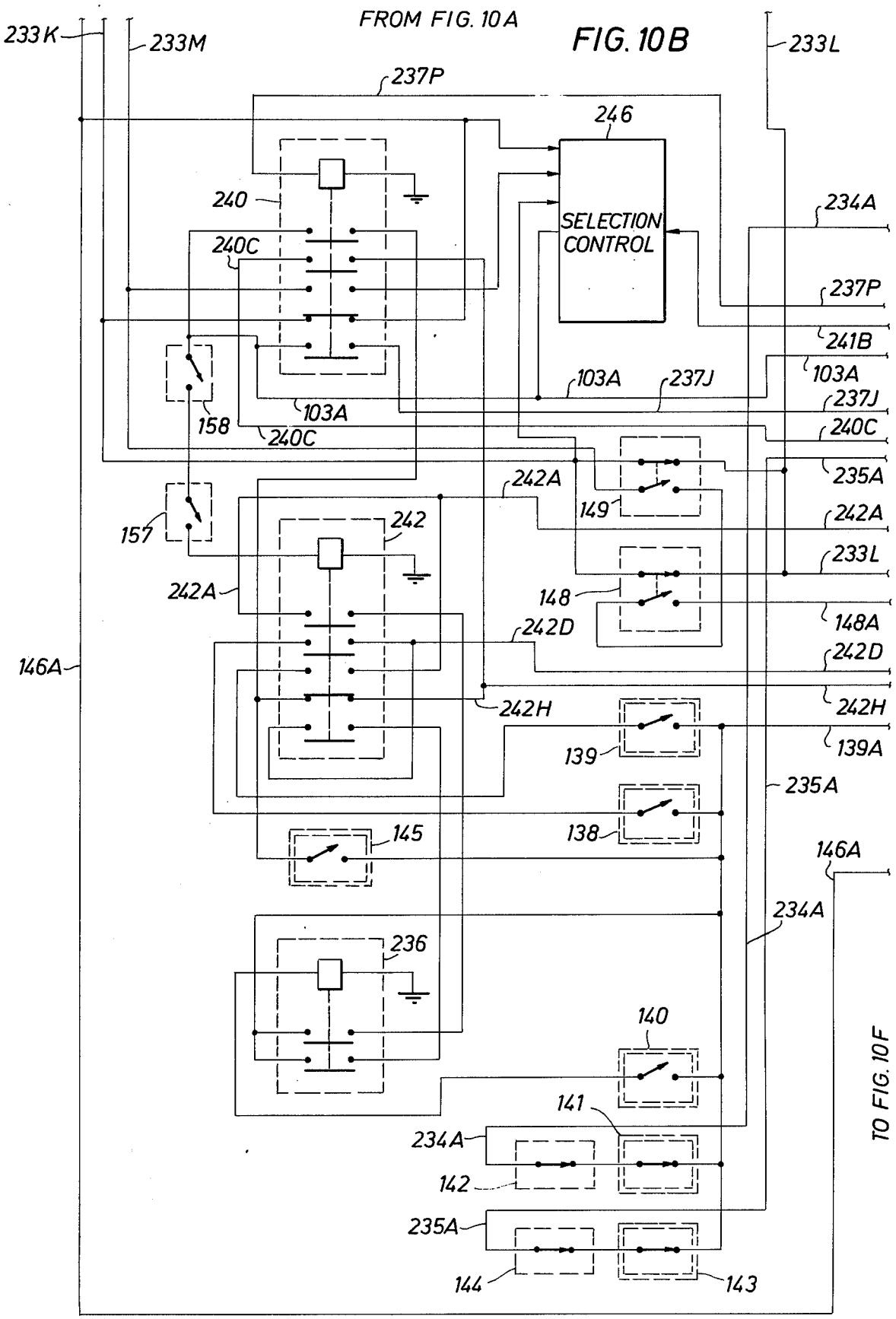
Figure 10C:
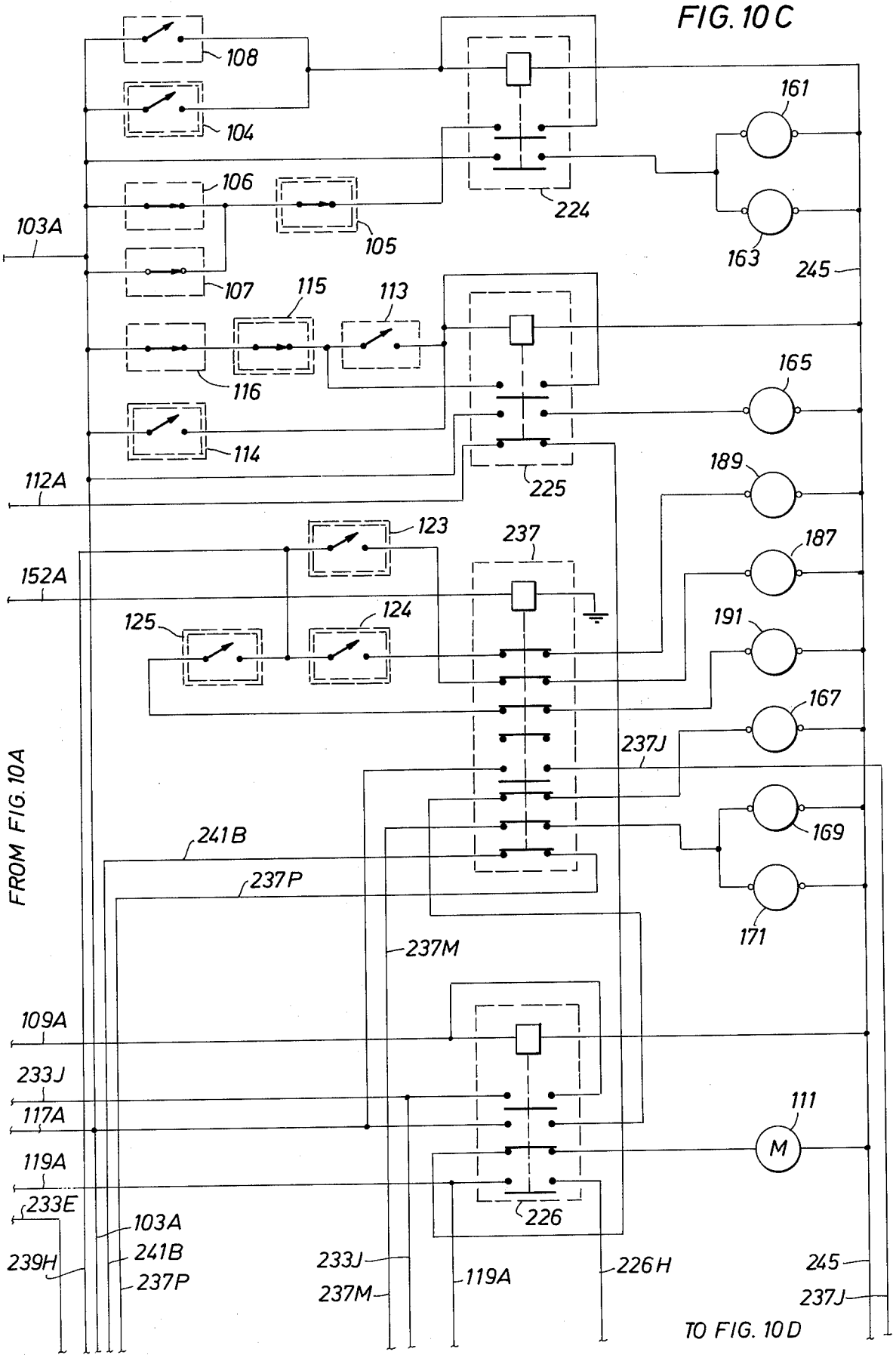
Figure 10D:
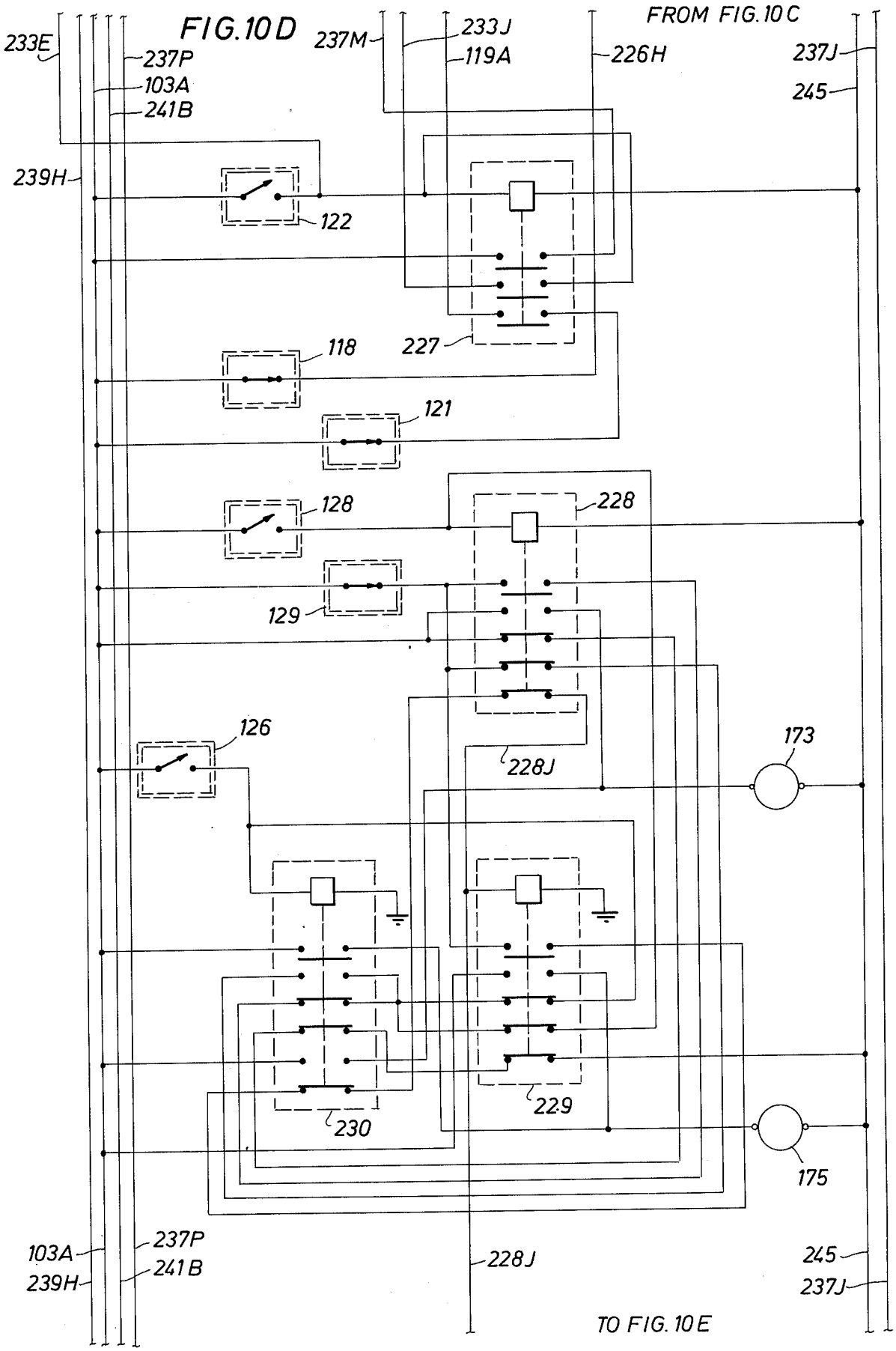
Figure 10E:
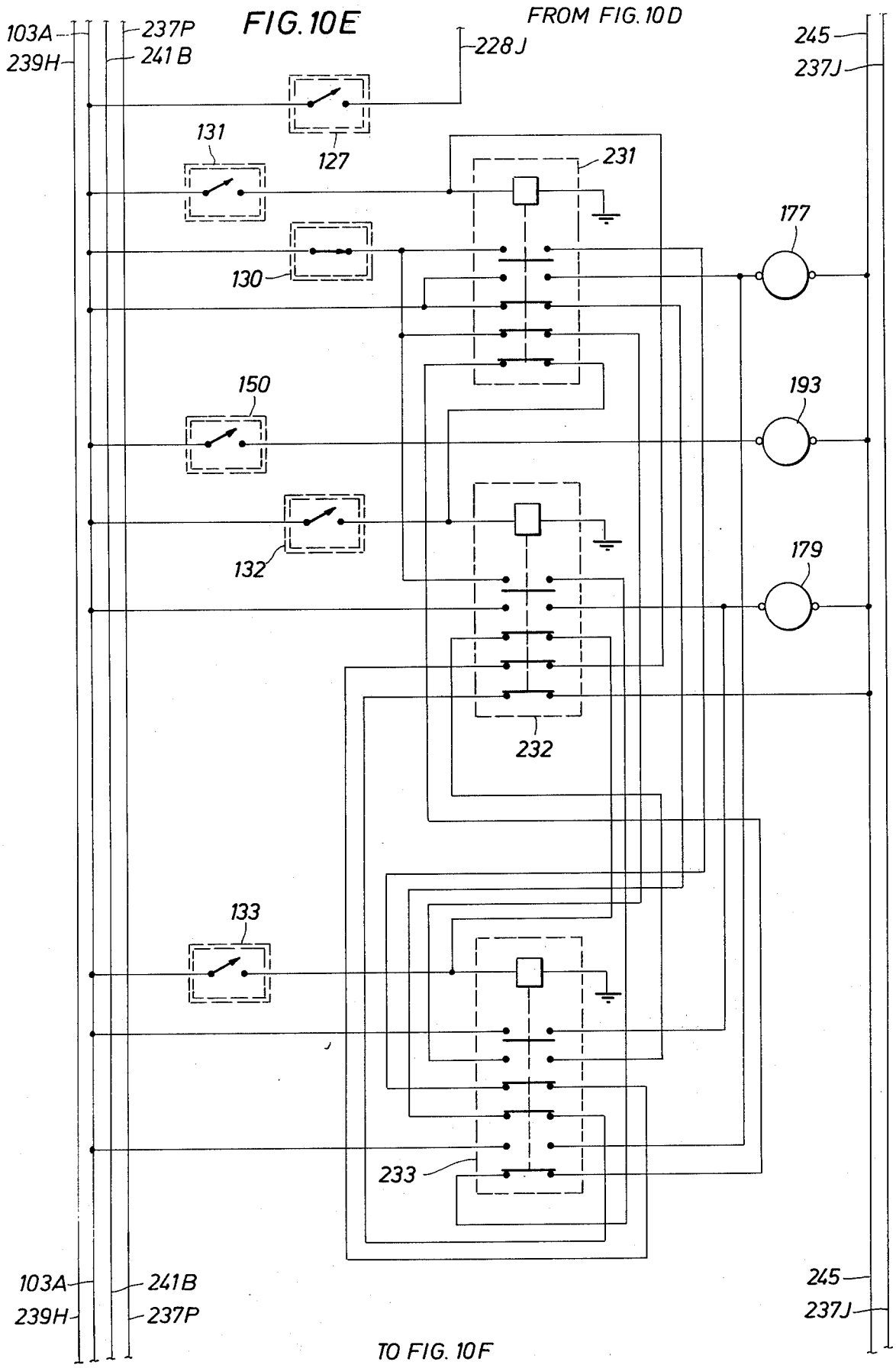
Figure 10F:
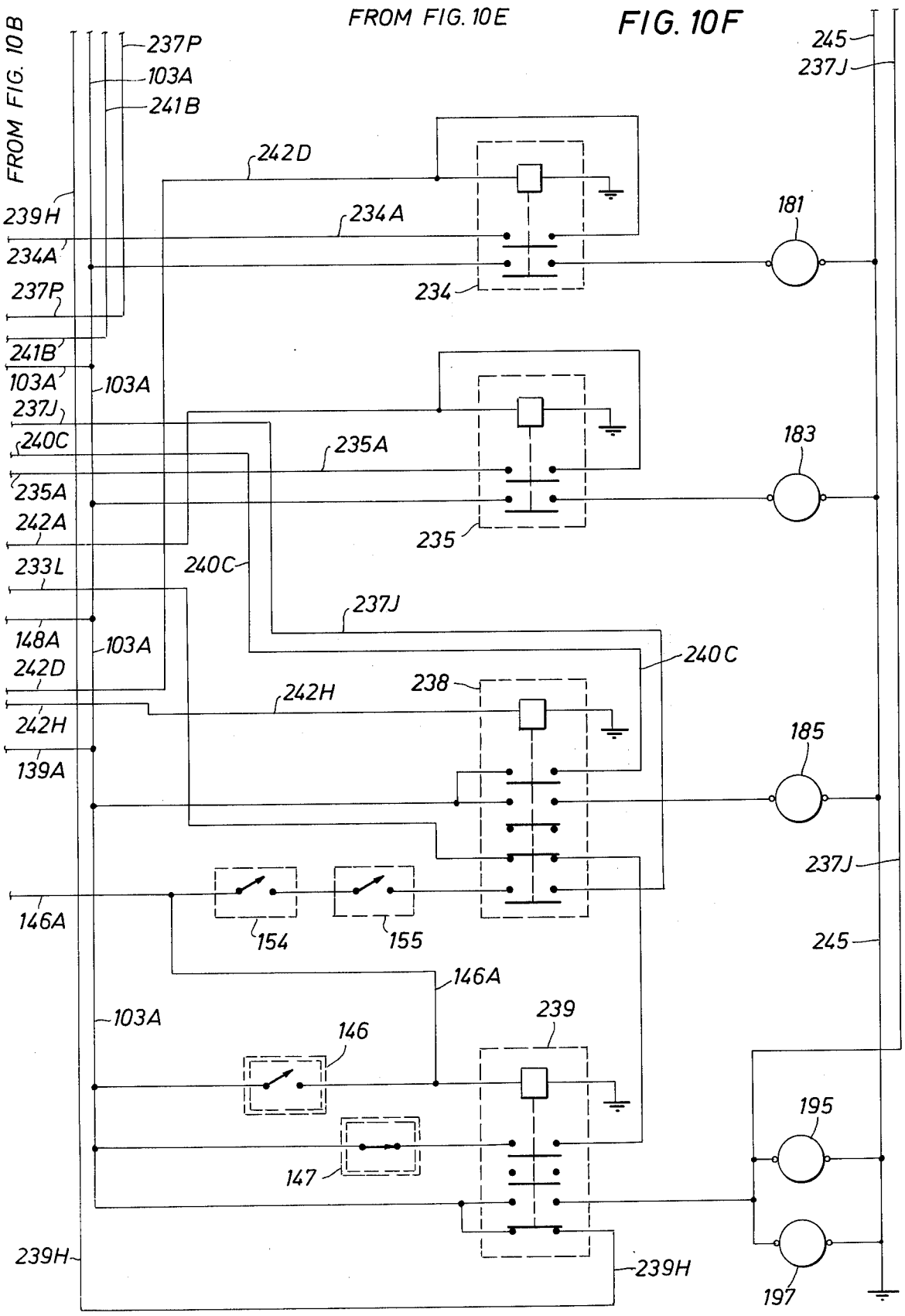

FIGS. 11 A–B present a schematic diagram of the details of selected circuitry depicted more generally in FIG. 10B.

DETAILED DESCRIPTION

Figure 1:
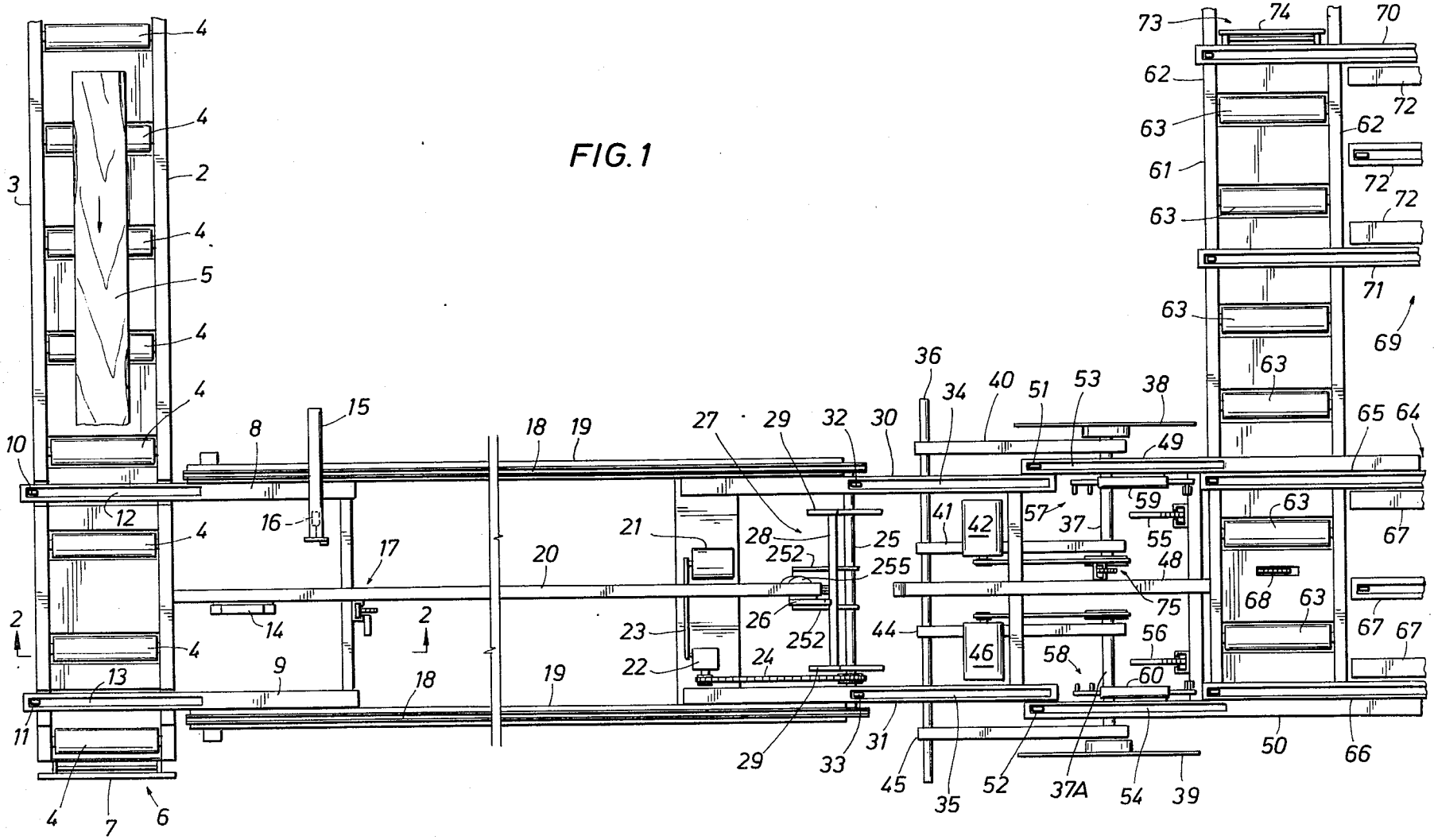

Referring now to FIG. 1, there may be seen an overhead view of a first conveyor assembly which extends from a point beside the slicing saw (not depicted) to the receiving end of a trimmer deck assembly as will hereinafter be described. The conveyor assembly may be any suitable device for longitudinally carrying a timber 5 and the like, such as a roller bed assembly 2 composed of a pair of rails 3 having a plurality of revolving rollers 4 mounted therebetween and rotatably driven by a suitable motor (not depicted). As may further be seen, a stop assembly 6 is preferably mounted at a suitable location in the roller bed assembly 2, and a pair of drag-off arm assemblies 8 and 9 are disposed across the roller bed assembly 2 and onto the trimmer deck assembly at its receiving end.

The stop assembly 6 and two drag-off assemblies 8 and 9 are preferably constructed and operated as is more particularly described in the aforementioned U.S. Pat. No. 3,943,808, although other conventional apparatus may be substituted therefor. Accordingly, the stop assembly 6 has an upwardly extending plate 7 which, when impacted by the timber 5, not only arrests the timber 5 across the drag-off arms 8 and 9, closes a switch 108 (see FIG. 10C) to actuate the two drag-off arms 8 and 9 to cause their teeth 10 and 11 to move along the slots 12 and 13 to carry the timber 5 laterally onto the two chains 18 extending along the sides of the deck, and also onto a spring-loaded pad-type switch 14 which, in turn, actuates the deck motor 21.

As may be further seen, the deck motor 21 is connected through an endless belt 23 to a reduction gear 22 which, in turn, is coupled through a sprocket chain 24 to drive shaft 25 which moves the pair of endless chains 18 which ride on the rails 19. Accordingly, the chains 18 will carry the timber away from the roller bed assembly 2 until it clears the switch 14, whereupon the motor 21 will stop until another timber is deposited onto the switch 14 by the two drag-off arms 8 and 9, and whereupon the sequence is repeated.

Referring again to FIG. 1, it will be seen that the trimmer deck illustrated therein extends from the roller bed assembly 2 to the receiving end of a trimmer saw section having its discharge end located adjacent a second roller bed assembly 61 or other suitable conveyor section. Accordingly, the discharge end of the trimmer deck is suitably provided with an unloading mechanism which is preferably a rotator assembly 27 composed of a pair of semi-circular members 29 mounted on a rotatable shaft 28. As will hereafter be explained in detail, whenever a timber is properly moved by the chains 18 into engagement with the two semi-circular members 29, it will depress and actuate a rotator check switch 26 which conditions the rotator assembly 27 for actuation, and which also de-energizes the trimmer deck motor 21.

The rotator assembly 27 may be selectively actuated by the operator. When the system is programmed for automatic operation, however, the rotator assembly 27 will be actuated when the drag-off arms 49 and 50, transfer a trimmed timber or tie onto second roller bed assembly 61. Accordingly, the shaft 28 rotates as hereinbefore stated to deposit the timber carried by the members 29 onto the slotted ends of a pair of loader arms 30 and 31, which may be constructed the same as the drag-off arms 8–9, but preferably having their two tooth members 32–33 reversed so as to push each newly received timber onto and across the slotted ends of the two unloader arms 49 and 50. As will hereinafter be explained, the loader arms 30–31 are actuated by a switch 243 (see FIG. 7) which, in turn, is controlled by the rotator assembly 27.

When the loader arms 30–31 have shifted their tooth members 32–33 to their extended positions in the slots 34–35, the unloader arms 49–50 (which may be constructed the same as the drag-off assemblies 8–9) will be energized to cause their respective tooth members 51–52 to travel along their slots 53–54 for the purpose of carrying the timber laterally into abutting engagement with a pair of upwardly thrustable stop members 55–56. Thereafter, its ends may be severed by the two trimming saws 38–39, which are each revolvably mounted on the ends of a pair of shafts 37 and 37A driven, in turn by two saw motors 42 and 46.

It will frequently happen that a timber will be deposited onto the unloader arms 49–50 so as to extend too far towards one or the other of the two saw blades 38–39. If the timber does not extend to saw 38, the operator will selectively relax the unloader arms 49–50, and actuate the "jog right" mechanism 57 which, in turn, is an upwardly extending claw-like member revolving is a sleeve 59 to engage the lower surface of the timber and shift it toward the saw 38. If the timber does not reach the other saw 39, the "jog left" mechanism 58 may be oppositely revolved in a similar sleeve 60 to shift the timber in the opposite direction.

As may be seen in FIG. 5, the two trimmer saw blades 38–39 are normally positioned below the timber to be trimmed. Referring again to FIG. 1, therefore, it will be seen that the saw blade 38 and shaft 37 is mounted on a pair of arms 40–41 having their opposite ends pivotally and slidably connected along a portion of a long pivot shaft 36. Similarly, the saw blade 39 and shaft 37A is mounted on a second pair of arms 44–45 which, in turn, are also pivotally and slidably amounted on another portion of the long pivot shaft 36. As will hereinafter be explained in detail, means is provided for swinging arms 40–41 and 44–45 upward to bring the saw blades into engagement with the ends of the timber to be trimmed, and to thereafter lower the blades 38–39 after trimming has been accomplished. In addition, suitable means is included for sliding the arms 40–41 and 44–45 along the long pivot shaft 36, whereby the spacing between the saw blades 38–39 may be changed as desired. In addition, either arms 40–41 or arms 44–45 may be separately raised and lowered whereby only one end of the timber may be cut if desired.

The two saw blades 38–39 are selectively raised and lowered by the operator, and they may be raised separately or in combination as may be desired. More particularly, the operator may actuate switch 138 (see FIG. 10B) to elevate the left trimmer saw 39, or switch 139 to elevate the right trimmer saw 38, or switch 140 to elevate both trimmer saws 38–39 simultaneously. Note that switches 138–140 are interconnected in momentary-type circuits, and that they are also spring-loaded open whereby they are merely depressed momentarily to cause the two saws to rise. Thus, when the left saw 39 rises to actuate the left saw up limit switch 142, this will cause the left saw 39 to reverse itself automatically and return to its original position. Similarly, the right saw 38 will continue to rise until it actuates the right saw up limit switch 144 (see also switch 275 and whisker 278 in FIG. 5), whereupon the right saw 38 will return to its original lowered position. If either of switches 138–140 are held closed by the operator, however, then the saws 38–39 will override switches 142 and 144 and continue to rise until their respective actuating cylinders (see cylinder 280 in FIG. 6) reach their limits. At this point, the saws 38–39 can only be retracted by means of switches 141 and 143.

After the saw blades 38–39 have been returned to their original positions below the timber, this will acuate switches 152–153 (see also switch 276 in FIG. 5) which, in turn, conditions the two unloader arms 49–50 to be relaxed, and which also conditions the two stop assemblies 55–56 to be lowered below the timber. When this occurs during the automatic mode, the unloader arms 49–50 will be actuated by switch 271 (see FIG. 6), whereby their two tooth members 51–52 will travel in the slots 53–54 to carry the trimmed timber off of the trimmer saw assembly and onto the second roller assembly 61. If the timber is improperly positioned thereon, the No. 3 flipper assembly 68, which is constructed the same as the No. 1 and 2 flipper assemblies 17 and 75, may be manually actuated by the operator to reposition or re-align the finished timber on the roller bed 61.

As hereinbefore stated, the purpose of the roller bed assembly 61 is to carry the trimmed timber to an appropriate holding location. If the timber is to be transferred onto the No. 1 timber holding deck, this may be effected by merely actuating the two drag-off arms 65–66, whereupon the timber will immediately be shifted onto the arm 67 of a suitable stacker apparatus of the type more particularly described in the aforementioned U.S. Pat. No. 3,943,808. If the timber is scheduled to be moved to the No. 2 timber deck 69, however, then the rollers 63 will be actuated to automatically carry the timber along the roller bed assembly 61 until it impacts against the plate 74 of the stop assembly 73 associated with the No. 2 timber deck 69. This, in turn, actuates the drag-off arms 70–71 to transfer the timber onto the arms 72 of the stacker apparatus associated therewith.

Figure 2:
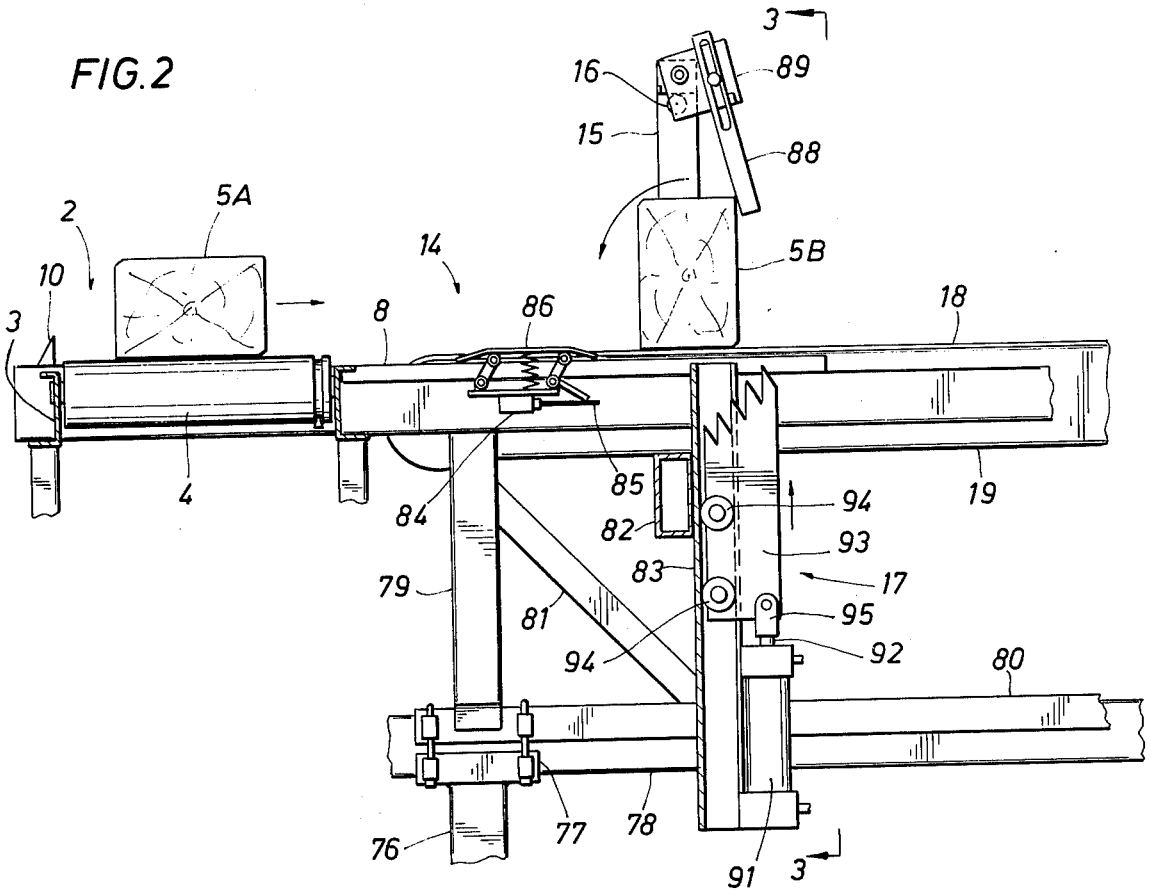
FIG. 2 is a simplified pictorial view of a portion of the deck assembly depicted in FIG. 1.
Figure 3:
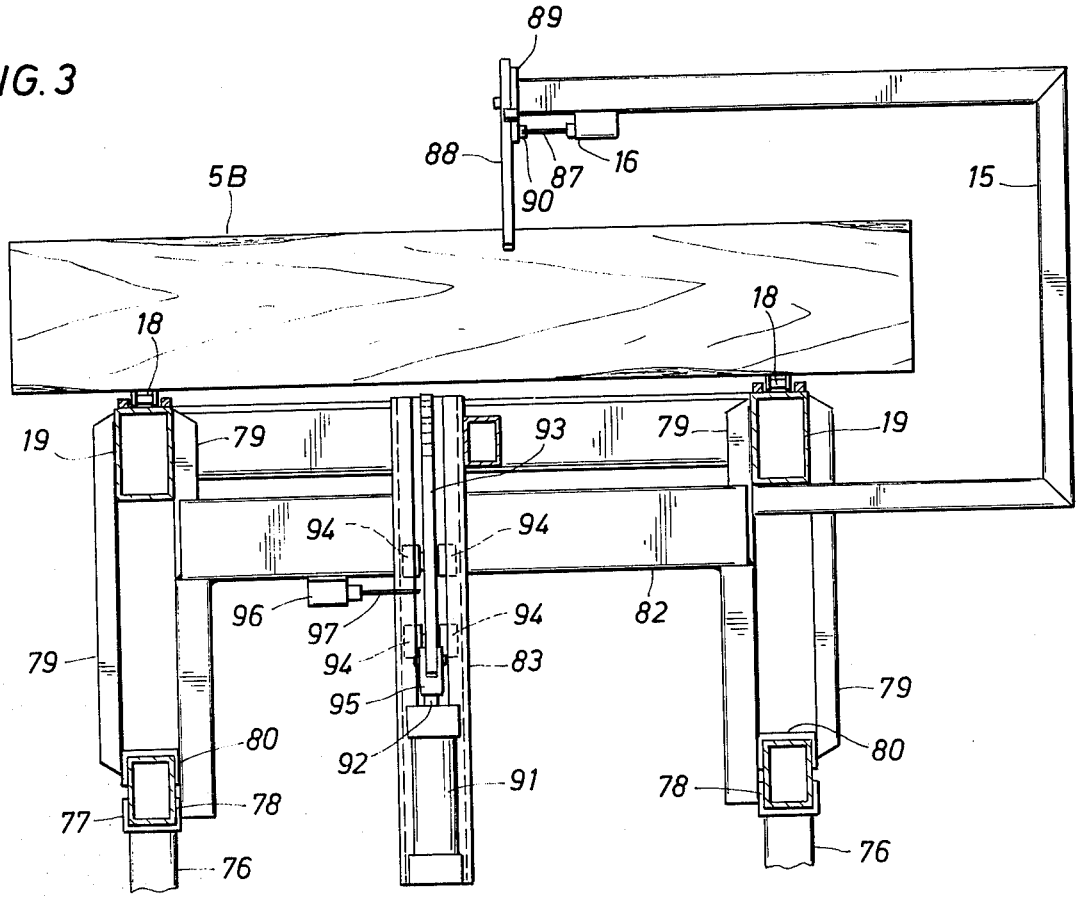
FIG. 3 is a simplified pictorial view of another portion of the deck assembly depicted in FIG. 2.

Referring now to FIGS. 2–3, there may be seen a simplified pictorial representation of the structural details of the receiving end of the trimmer deck assembly depicted in FIG. 1. As hereinbefore stated, the various sections of the sawmill are preferably formed to be disposed on a suitable platform which, as indicated in FIGS. 2–3, may be composed of a plurality of vertical piers 76 each having an inverted saddle member 77 mounted on the upper end for supporting a longeron 78 which, in turn, serves to support each of the sections of the sawmill at a preselected location therein. Accordingly, the trimmer deck assembly may be seen to be preferably composed of a plurality of leg members 79 vertically interconnected between a pair of spaced-apart side rails 19 and a pair of long saddle members 80 which, in turn, are adapted to engage the upper surfaces of the longerons 78. In addition, cross members 82 and angle brackets 81 may be included for providing strength to the assembly.

As hereinbefore stated, the two drag-off assemblies 8 and 9 extend from the receiving end of the trimmer deck assembly to and across the transversely adjacent roller bed assembly 2. The operating and structural details of these two components of the system have been fully described and illustrated in the aforementioned U.S. Pat. No. 3,943,808, and therefore an equally detailed description will not now be repeated herein. It should be noted, however, that each such component includes a pneumatically actuated cylinder (not depicted) assembly with a tooth-like member 10-11 pivotally mounted on the free-traveling end of each piston rod (not depicted) therein. Each of the two tooth-like members 10-11 normally project up through one of the slots 12-13 on the opposite side of the roller bed assembly 2 and the timber 5A carried thereon. When the timber 5A impacts against the plate 7 of the stop assembly 6, as hereinbefore explained, the plate 7 actuates a switch 108 (not depicted in FIGS. 1–3) to energize the cylinders (not depicted) in the two drag-off assemblies 8-9. When this occurs, the two tooth members 10-11 will be drawn through the two slots 12-13 to drag the timber 5A off of the roller bed assembly 2 and onto the trimmer deck switch assembly 14. Upon reaching their travel limits, however, a switch (not depicted) located in each drag-off assembly 8-9 is actuated to cause the two cylinders (not depicted) therein to return the two tooth members 10-11 to their original positions.

It should be noted that the two tooth members 10-11 are preferably arranged and adapted to resist arcuate movement in one direction, but to yield to movement in the other direction. Accordingly, the two members 10-11 remain erect only when carrying the timber 5A from the roller bed assembly 2 to the trimmer deck assembly. If the tooth members 10-11 encounter another body upon returning to their original position, they will fold down and ride under it rather than pushing it off of the roller bed assembly 2 in the opposite direction.

As also explained, it is desirable for all timbers to lie on their broader sides when being loaded onto the trimmer deck assembly, as indicated by timber 5A in FIG. 2. If a timber is inadvertently loaded thereon while standing on its narrower edge, however, as illustrated by timber 5B in FIG. 2, means is provided to re-position it.

Referring again to FIGS. 2–3, it will be noted that a side bracket 15 is provided for the purpose of dangling above the trimmer deck assembly means for examining the position of each timber 5A-B carried thereon. More particularly, this examining means may be seen to include a pendulum lever 88, which is adjustably mounted on a plate 89 which, in turn, is pivotally fixed to the end of the side bracket 15. In addition, a knob 90 or other protuberance is provided on the back side of the plate 89 to deflect the whisker 87 of a switch 16, which is also carried by the side bracket 15, whenever the lever 88 hangs in its normal position above the trimmer deck assembly.

As hereinbefore stated, whenever the drag-off arms 8-9 are actuated to remove a timber 5 from the roller bed assembly 2, they will move the timber 5 far enough to actuate the trimmer deck switch assembly 14 which, in turn, may be seen to be composed of a switch 84 having a whisker 85 deflected when the spring-loaded pad assembly 86 is depressed by the weight of the timber 5. This, in turn, actuates the trimmer deck motor 21 to cause the chains 18 to carry the timber 5 further along the trimmer deck assembly until it clears and releases the pad assembly 86, whereupon the motor 21 stops.

It should be noted that each time the pad assembly 86 is depressed by a newly received timber, the chains 18 will not only carry that timber along until it is moved past the pad assembly 86, but they will also carry all preceding timbers along the deck assembly and away from the pad assembly 86. Thus, each timber thereon will be spaced from its adjacent timbers a distance determined by the length of the pad assembly 86, and this provides unimpeded rotation of each timber upon actuation of the No. 1 flipper 17 as will hereinafter be explained.

Movement of the chains 18 will, of course, carry each timber under the dangling pendulum lever 88. The lever 88 is preferably suspended from plate 89 above the trimmer deck assembly a distance such that a timber positioned as shown by timber 5A will not disturb it. When the timber is positioned as shown by timber 5B, however, it will deflect the lever 88 to release the whisker 87 of the switch 16, and this will actuate the No. 1 flipper assembly 17 to overturn the upright timber 5B.

Referring again to FIGS. 2-3, it will be noted that the No. 1 flipper 17 is composed of an engager member having a plurality of rollers 94 located along one edge and on both sides, and further having a jagged or serrate upper end. The rollers are disposed within a vertical channel member 83, whereby the engager member 93 is vertically movable both up and down, but that it is normally disposed below the upper surface of the trimmer deck assembly as indicated in FIGS. 2-3. The switch 16 is a normally-closed device, but it is usually held open by the weight of the lever 88. When the lever 88 is deflected, however, the switch 16 will close to actuate a pneumatic cylinder 91 which, in turn, extends its piston rod 92. The lower end of the engager member 93 is coupled to the free-traveling end of the piston rod 92 by a clevis 95 or the like, and thus extension of the piston rod 92 will drive the upper end of the engager member 93 against the lower leading edge of the upright timber 5B to flip it over and backwards.

Referring now to FIG. 3, it will be noted that when the piston rod 92 becomes fully or substantially fully extended, the whisker 97 will be deflected by one of the rollers 94 or other suitable portion of the engager member 93, to actuate the switch 96. This, in turn, causes the cylinder 91 to retract the piston rod 92 to return the engager member 93 to its original position.

Figure 5:
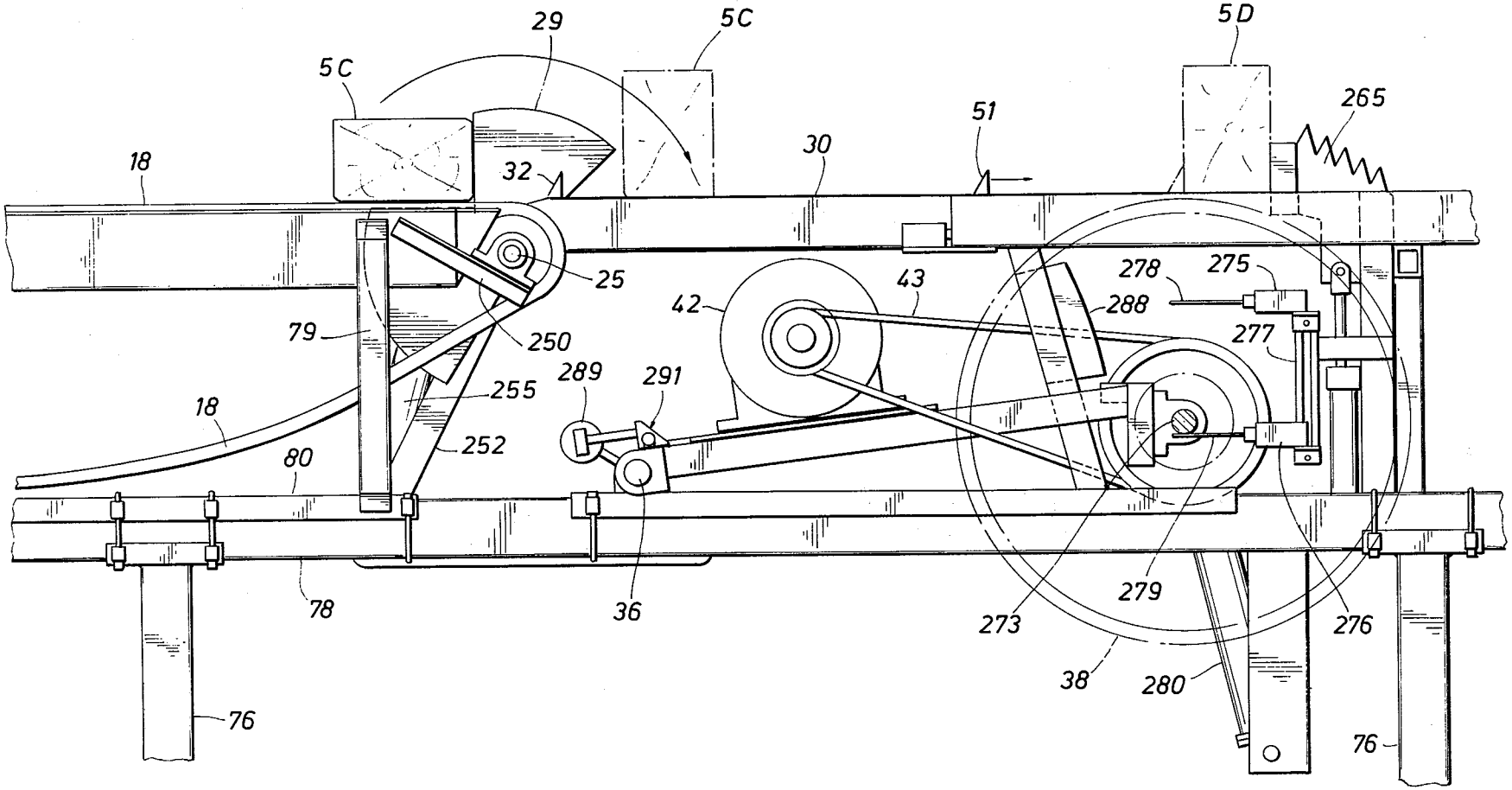
FIG. 5 is a simplified view, partly functional and partly pictorial, of different portions of the trimmer saw assembly depicted in FIG. 1.
Figure 6:
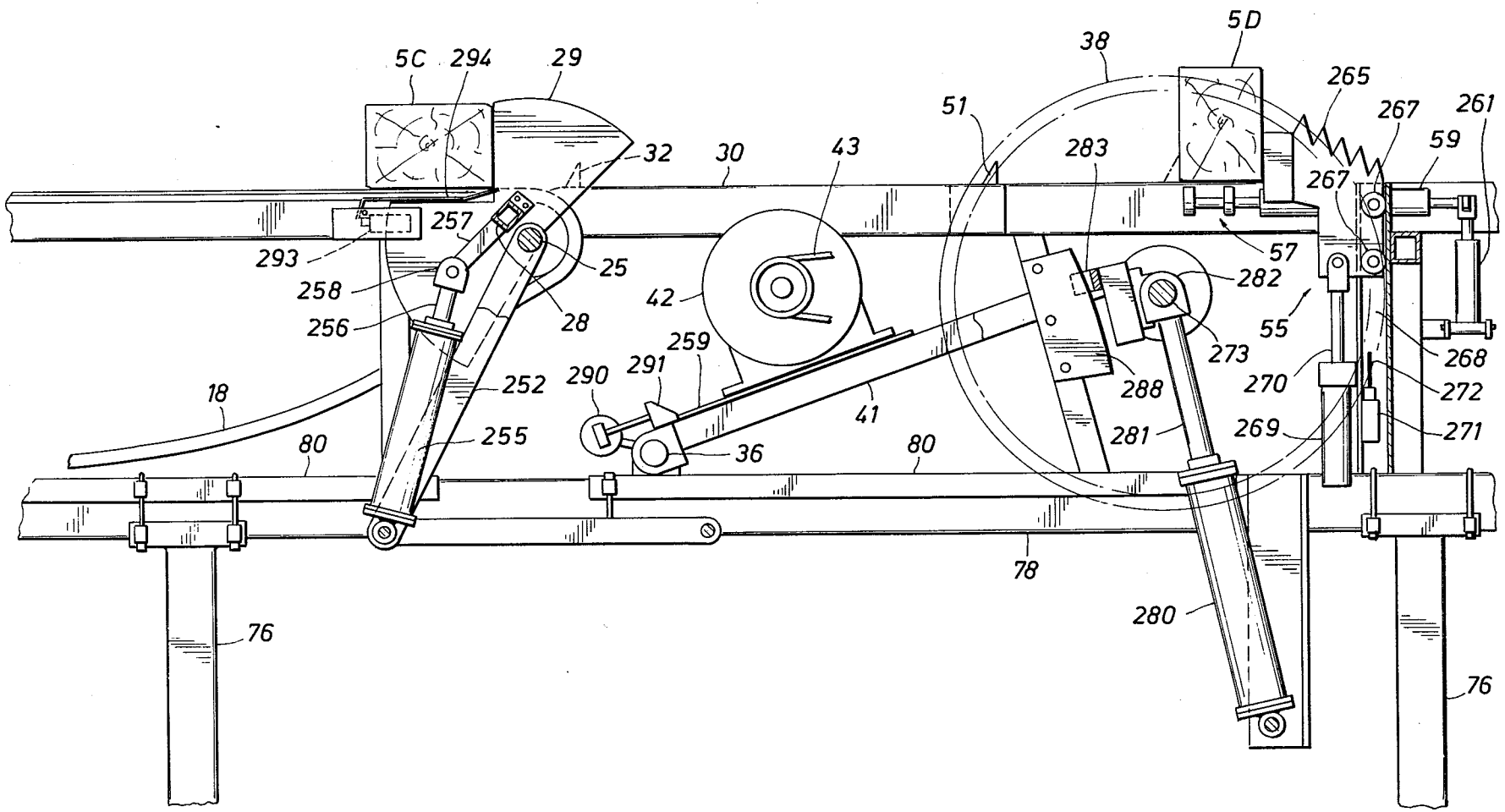
FIG. 6 is another different view of the functions and mechanisms depicted in FIG. 5.

Referring now to FIGS. 5-6, there may be seen a simplified pictorial representation of the discharge end of the trimmer deck assembly. As hereinbefore explained, the endless chains 18 which carry the timbers 5 to the trimming saws 38-39, are moved by a pair of sprocket wheels fixedly mounted at opposite ends of a drive shaft 25 and interconnected with the trimmer deck motor 21 by a sprocket chain 24 and the like. In addition, however, there may be seen a pair of generally semi-circular members 29, which are slidably mounted at the ends of the drive shaft 25 and fixedly interconnected by another shaft 28 to constitute the basic components of the rotator assembly 27 hereinbefore mentioned. More particularly, the two semi-circular members 29 are each provided with a rectangular notch or cut-out portion of a size and shape to receive and accommodate a timber 5C, when it is carried therein by the traveling chain 18, and when they are in their receiving position as depicted in FIG. 6. Thus, when the two semi-circular members 29 are rotated about the drive shaft 25, as will hereinafter be explained, they will arcuately swing over the timber 5C to deposit it across the loader arm assemblies 30-31 as previously stated, whereupon the timber 5C will be in its erect position as indicated in FIG. 5.

As illustrated in FIGS. 5-6, rotation of the two semi-circular members 29 may be effected by the pneumatic cylinder 255 which is anchored between a pair of braces 252 angularly extending to the drive shaft 25, and which has the free traveling end of it piston shaft 256 coupled through a clevis 258 and lever arm 257 to the shaft 28. Actuation of the cylinder 255 may be selectively effected by the operator, as hereinbefore explained, or it may be sequentially effected by the return of the unloader arm assemblies 49-50. On the other hand, the cylinder 255 will not actuate until a timber 5C has depressed the leaf-type actuator 294, to actuate the switch 293, by moving fully into the notches of the semi-circular members 29.

Figure 7:
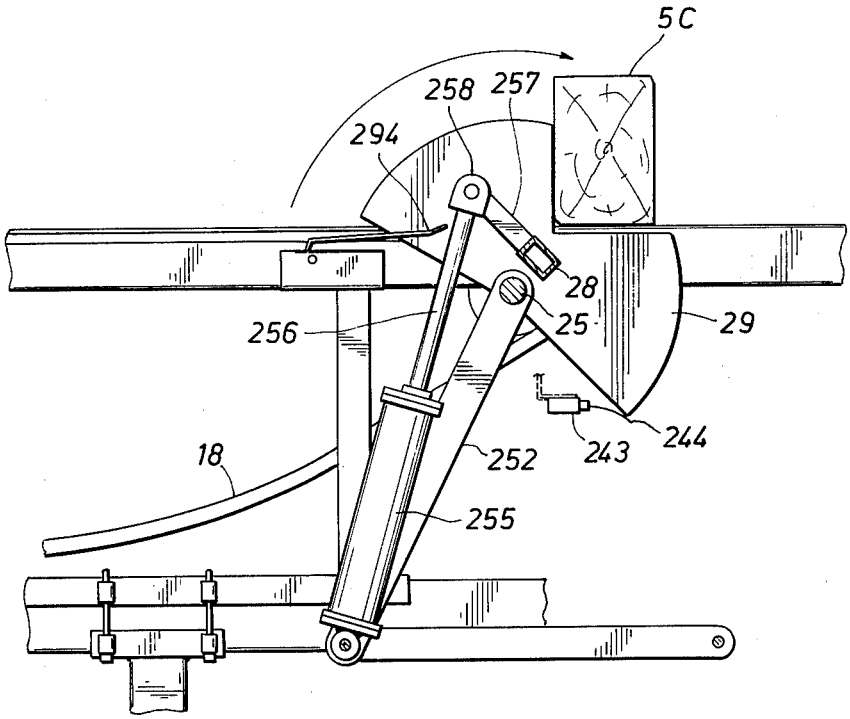
FIG. 7 is a further simplified pictorial view of a portion of the apparatus depicted in FIGS. 5 and 6.

Referring again to FIGS. 4-6, there may also be seen a pictorial representation of certain basic features of the trimmer saw assembly which, in turn, constitutes the other major component of the overall trimmer section of the sawmill. In particular, there may be seen the two loader arms 30-31 which are formed substantially as the two drag-off arms 8-9 hereinbefore described, and which therefore have a pair of tooth-like engaging members 32-33 which extend upwardly therefrom in the slots 34-35, and which are slidably extendable through such slots 34-35 to shove the erect timber 5C forward onto a similar pair of unloader arms 49-50. The loader arms 30-31 are actuated when one of the two semi-circular members 29 reaches full rotation to deflect the whisker 244 of switch 243, as indicated in FIG. 7, but the unloader arms 49-50 are actuated to pick up and shift the timber 5D into abutting engagement with the two upright stop members 265 when the loader arms 30-31 reach their full extension. Thereafter, one or both of the two rotating trimmer saw blades 38-39 may be raised to sever the ends of the timber 5D while it is fixed in this position.

Figure 4:
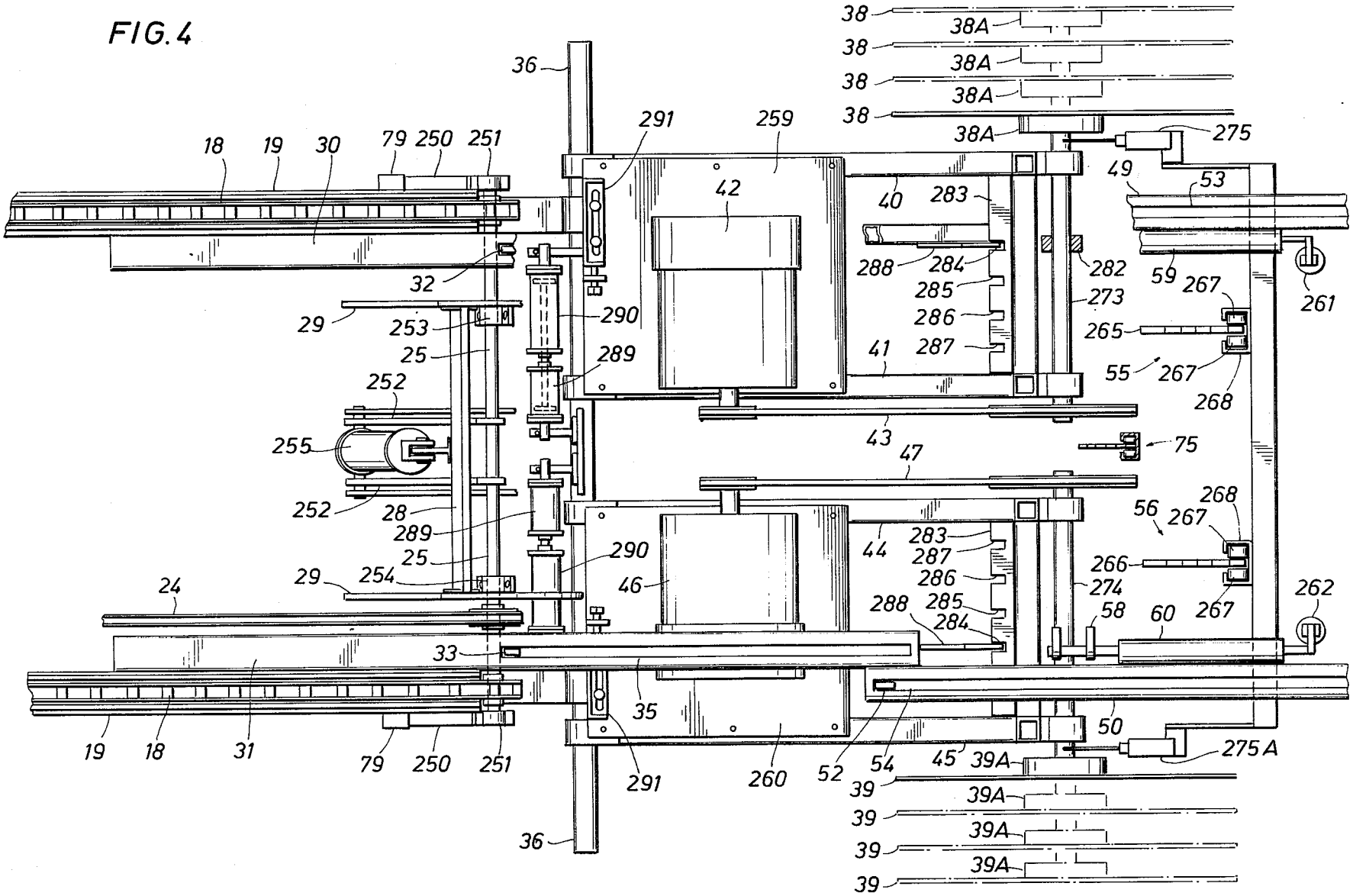
FIG. 4 is a different and more detailed pictorial view of the trimmer saw assembly and portions of the deck assembly depicted in FIG. 1.

Referring now to FIG. 4, there may be seen another but more detailed pictorial view of the trimmer saw assembly, and more particularly depicting how the right trimmer saw blade 38 is fixed to a circular boss 38A which, in turn, is rotatably mounted between the ends of a pair of arms 40-41 which carry the right trimmer motor 42 on a suitable base plate 259. The left trimmer saw blade 39, in turn, is similarly fixed to a boss 39A which, in turn, is also rotatably mounted between the ends of another pair of arms 44-45 which carry the left trimmer motor 46 on a suitable base plate 260.

Referring again to FIG. 4, it will be noted that the two trimmer saw blades 38-39 are not only independently movable in a vertical direction, but also in a horizontal direction. More particularly, it may be seen that an assembly of two pairs of short and long stroke cylinder assemblies 289-290 are provided for shifting the arms 40-41 and 44-45 along the long pivot shaft 36 according to a plurality of preselected locations each spaced, for example, 6 inches apart. In other words, each of the two short stroke cylinders 289 will have a 6 inch stroke, and each of the two long stroke cylinders 290 will have a 12 inch stroke. Thus, if all cylinders 289-290 are fully retracted, both saw blades 38-39 will be spaced closest together and both will be in "Position No. 1."

If the separation between the trimmer blades 38-39 is to be increased by only 6 inches, this can be effected by actuating only the left short stroke cylinder 289 to shift the left trimmer saw blade 39 to Position No. 2. If the left trimmer saw blade 39 is to be moved to Position No. 3, which is 6 inches from Position No. 2, then the left long stroke cylinder 290 is actuated while the left short stroke cylinder 289 is restored to its original state. If the left trimmer saw blade 39 is to be shifted to Position No. 4, however, then the left short stroke cylinder 289 is again actuated.

It is desirable that the two trimmer saw blades 38-39 be located only at their respective Positions No. 1–4 as hereinbefore explained, and thus a positioning plate or bar 283 is mounted between each of the two pairs of arms 40-41 and 44-45 and is provided with pre-arranged slots or notches 284-287 which, in turn, each accommodate a fixedly and vertically positioned blade 288. Accordingly, if the left trimmer blade 39 is properly located at either Position No. 1–4, its positioning bar 283 will be located so that the proper one of its notches 284-287 will be aligned with its positioning blade 288. If none of the notches 284-287 are exactly aligned with the positioning blade 288, however, the positioning bar 283 will engage the positioning blade 288 to prevent the left trimmer saw blade 39 from being raised.

It will be apparent that it is desirable to provide for adjustment of the saw carriages, however, with respect to the cylinders 289-290. Thus, a suitable adjustment means 291 is preferably included on base plates 259-260, whereby the position of the two arms 40-41 and base plate 258 may be shifted along the long pivot shaft 36, and whereby the position of arms 44-45 and plate 260 may be similarly adjusted. In addition, suitable means may be included for selectively adjusting the position of the short and long stroke pistons 289-290 in increments of one-half inches, relative to the long pivot shaft 36. In this respect, however, it should also be noted that this requires compensating adjustment of the positioning blades 288.

As hereinbefore stated, each of the two trimmer saw blades 38-39 may be raised and lowered independently of the other, and thus each is provided with its own elevating means. Referring now to FIGS. 5–6, it may be seen that the right trimmer saw blade 38 may be moved by means of a fixedly anchored cylinder 280 having the free traveling end of its piston rod 281 slidably and rotatably coupled to its drive shaft 273 by a clevis 282 or the like, and that the saw blade 38 is raised by extension of the piston rod 281. It should further be noted that when the piston rod 281 is fully retracted, the drive shaft 273 (or other suitable part of the assembly) will deflect the whisker 279 to actuate the "right saw down" switch 276, and that the piston rod 281 will become extended only far enough to deflect the whisker 278 of the "right saw up" switch 275. The purpose of the two switches 275-276 is to limit vertical travel of the right trimmer saw blade 38, and thus they are preferably adjustably spaced apart by means of a slotted bracket 277 or the like, as shown in FIG. 5.

The left trimmer saw blade 39 is similarly moved and controlled. However, its limit switches are not depicted in FIGS. 5–6, and only the left saw up switch 275A is shown in FIG. 4.

Referring again to FIG. 4, there may be seen a simplified representation of the No. 2 flipper assembly 75 which, however, is selectively operable by the operator and which is constructed the same as the No. 1 flipper assembly 17 as depicted in FIGS. 1–3. In addition, there may be seen a more detailed representation of both the "jog left" and "jog right" assemblies 57-58, wherein the two bar members are rotatably moved in the sleeves 59-60 by cylinders 261-262.

Referring more particularly to FIG. 6, there may be seen a more detailed illustration of apparatus exemplary of the tie stops 55-56 depicted briefly in FIG. 1 and in FIG. 4, and more particularly relating to the right tie stop assembly 55. In particular, this assembly may be seen to include a stopping member 265 having a plurality of rollers 267 mounted along one edge and on both sides, and which ride in a suitable channel member 268 whereby the stopping member 265 may be raised and lowered to stop or pass the timber 5D then being engaged by the unloader arms 49-50. The right stopping member 265 is further interconnected to the free traveling end of the piston rod 270 of a cylinder assembly 269, and a switch 271 is arranged so that it may be actuated whenever the piston rod 270 is retracted and its whisker 272 is deflected by a roller 267 or other suitable part of the right stopping member 265.

Each of the two tie stop assemblies 55-56 will preferably be raised and lowered together, notwithstanding each is provided with a separate actuating cylinder. Thus, the arrangement depicted in FIG. 8, wherein the left tie stop assembly 56 is lowered independently of the right tie stop assembly 55, is merely to illustrate the relationship of the various components in these two different modes.

Figure 8:
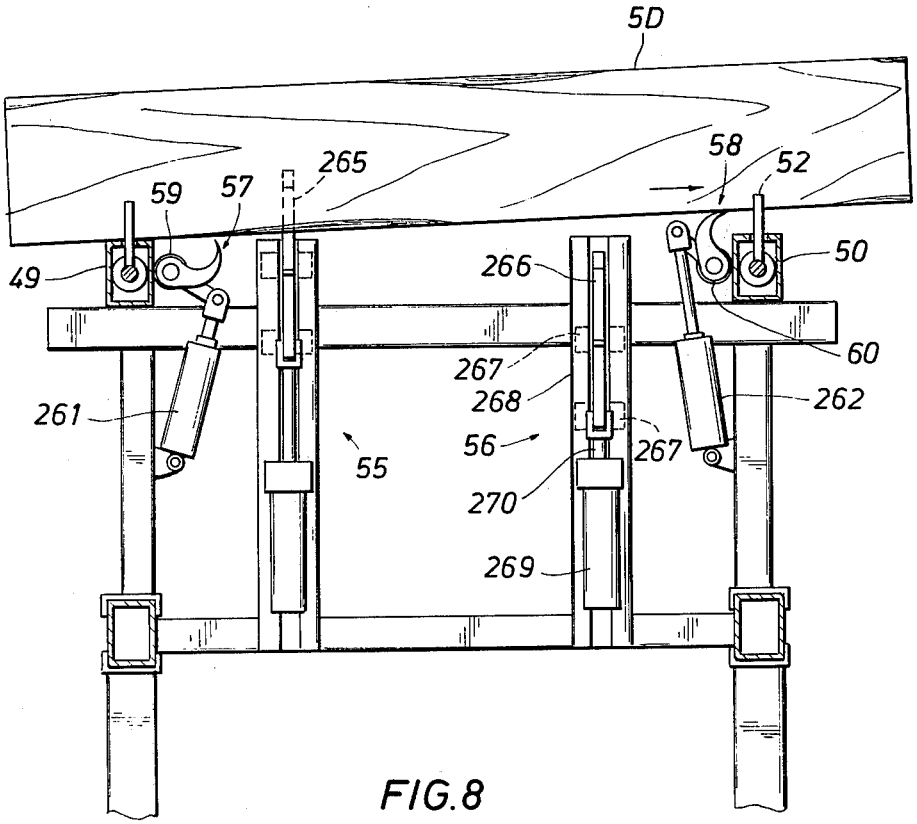
FIG. 8 is a simplified pictorial view of the details of another portion of the apparatus depicted in FIG. 1.

Referring now to FIGS. 6 and 8, however, it will be seen that the "jog left" and "jog right" assemblies 57-58, which are more generally illustrated in FIGS. 1 and 4, are operable independently of each other. More particularly, FIG. 8 shows the jog left assembly 58 in its actuated condition for shifting the timber 5D a limited distance toward the left trimmer saw blade 39 (not depicted in FIG. 8), whereby the cylinder 262 has been actuated to rotate the claw-like member in sleeve 60 to pick up and carry over the timber 5D. If it is desired to shift the timber 5D in the opposite direction to the right trimmer saw blade 38, then the "jog left" cylinder 262 will be retracted and the "jog right" cylinder 261 will be actuated to rotate the claw of the job right assembly 57 in the opposite direction.

Figure 9A:
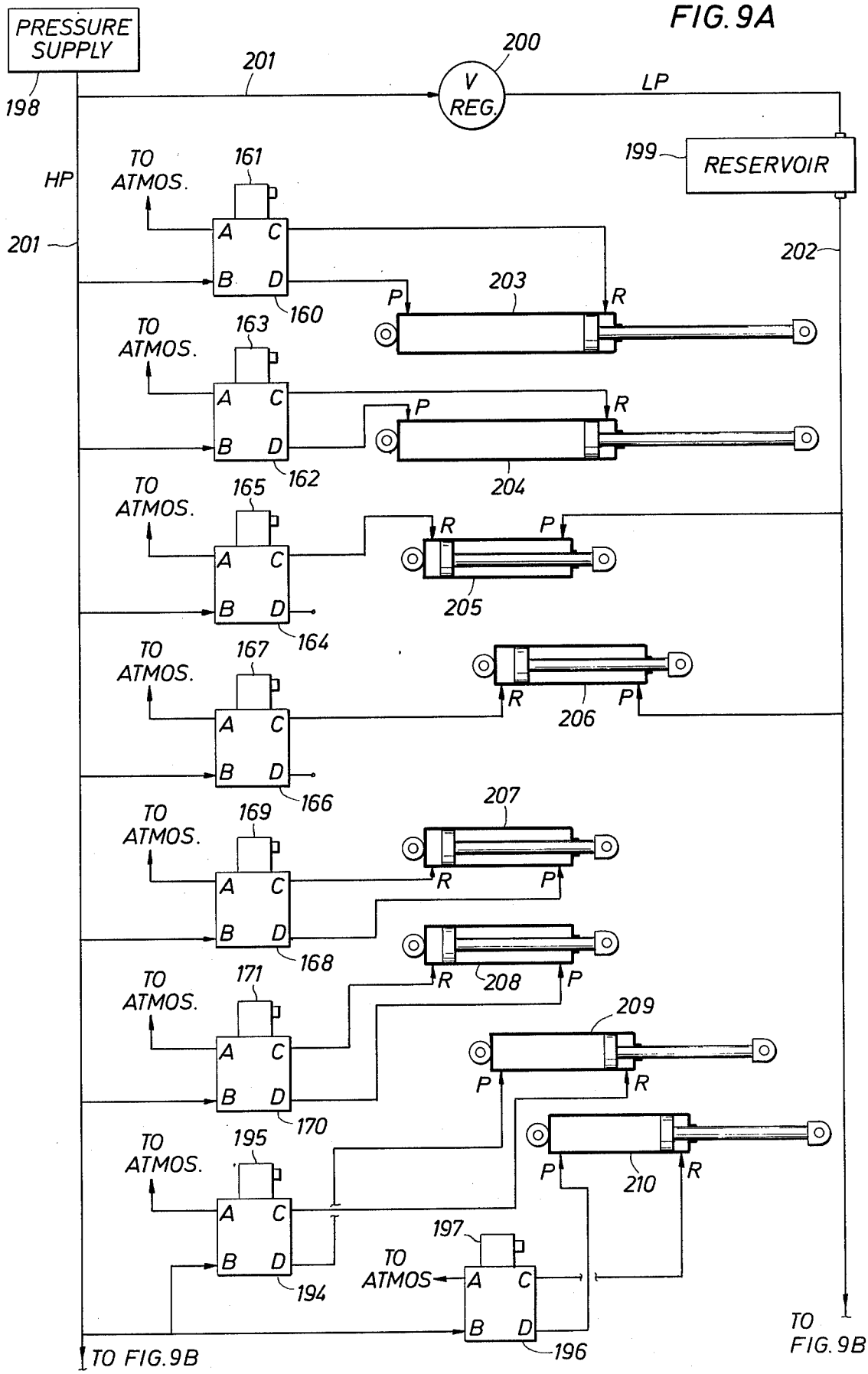
Figure 9B:
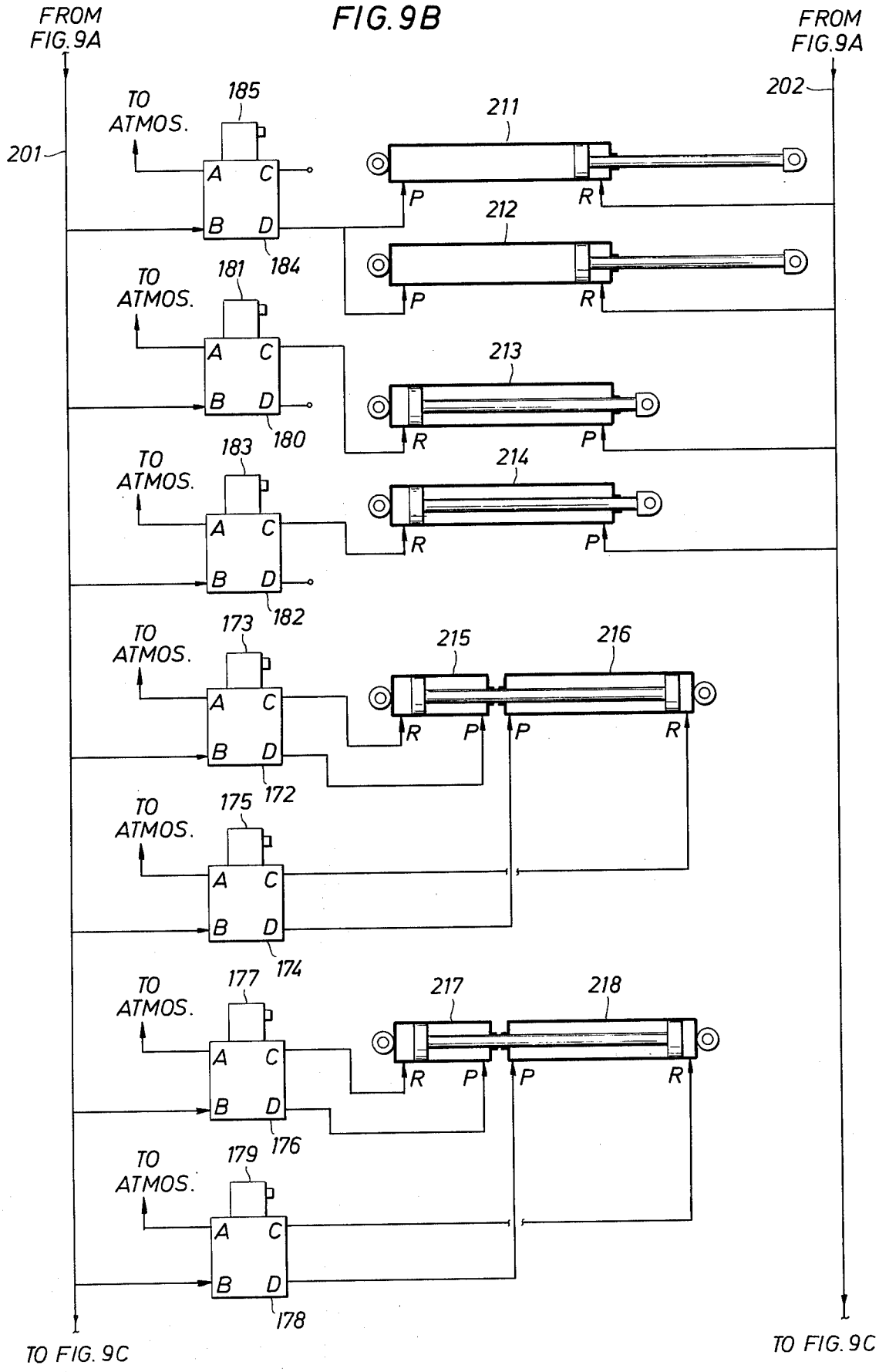
Figure 9C:
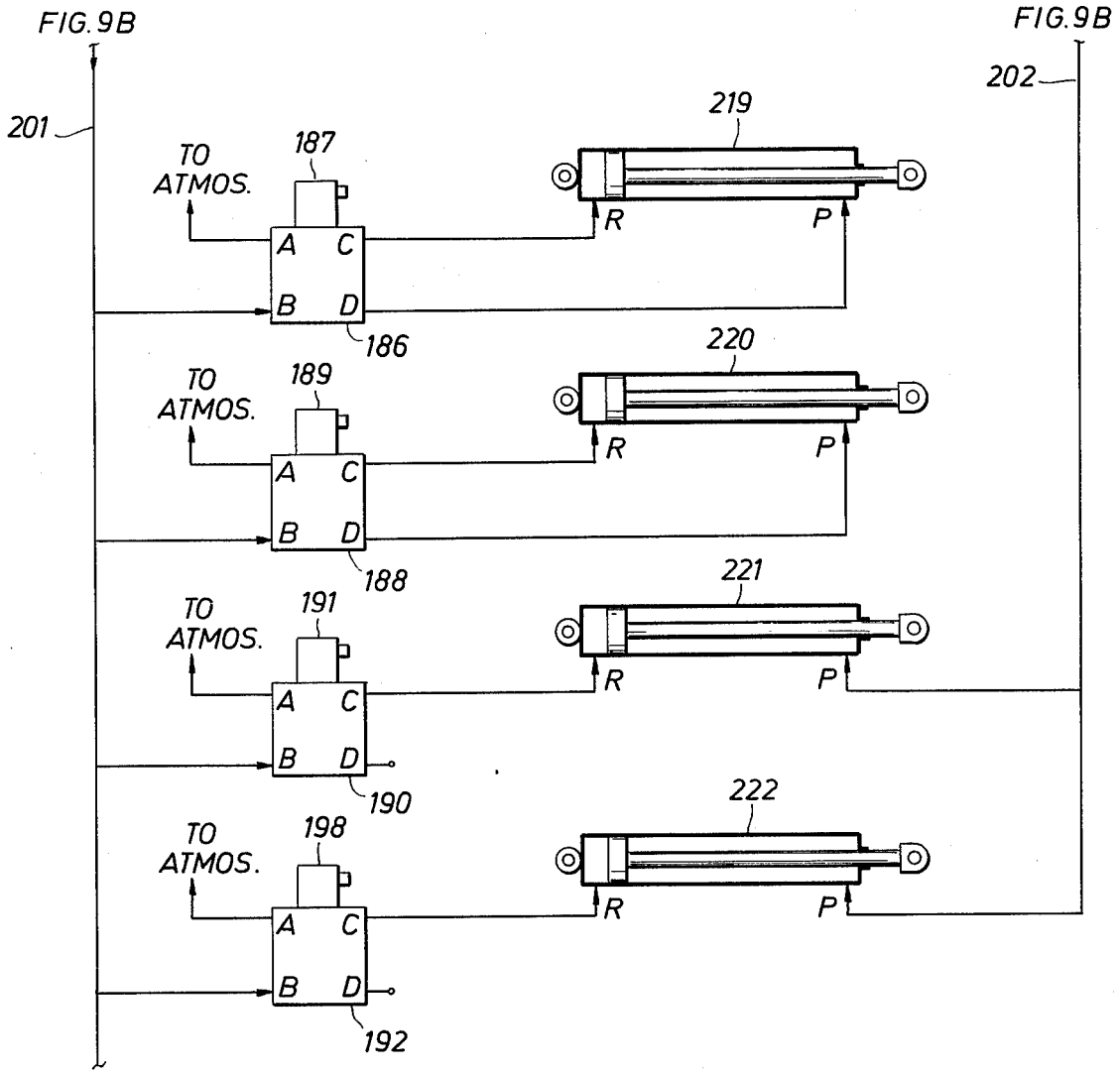

Referring now to FIGS. 9A–C, there may be seen a simplified functional illustration of the major actuating means for operating the components depicted in FIGS. 1–8 according to the concept of the present invention. In particular, such a system may conveniently include a suitable source 198 of pneumatic pressure which, in turn, is connected to a high pressure line 201. As will be apparent, the system preferably uses both high and low pneumatic pressure, and thus a section of the high pressure line 201 will preferably connect with a suitable pressure regulator 200 which, in turn, is connected through a suitable reservoir 199 to a low pressure line 202.

The operation of the system depicted in FIGS. 9A–C is better understood if considered in sections. More particularly, cylinders 203-204 are the driving means in the drag-off arms 8-9 which travel the tooth members 10-11 depicted in FIG. 1, and thus they are normally extended. Whenever a timber 5 on the first roller bed 2 impacts against the plate 7 of the stop assembly 6, however, switch 108 in FIG. 10C will close to energize both solenoids 161, 163 of the left and right drag-off control valves 160, 162, whereby pressure will be connected from line 201 through ports B-C in both components to retract cylinders 203-204, and whereby ports A-C are connected to provide a return connection. As will also be explained, whenever cylinders 203-204 become fully retracted, however, switches 106-107 will be actuated to de-activate valves 160, 162 and restore them to their original position, whereby the cylinders 203-204 will re-extend.

Cylinder 205 in FIG. 9A corresponds to the cylinder 91 in FIGS. 2–3 which actuates the No. 1 flipper assembly 17, and thus cylinder 205 is normally held in a retracted position by pressure from the reservoir 199 and low pressure line 202. When switch 114 is closed, the No. 1 flipper control valve 164 will reposition to connect ports B and C, and high pressure from line 201 will override the pressure in line 202 to extend cylinder 205. As will hereinafter be explained, switch 114 is preferably momentary in character, but when the No. 1 flipper return switch 115 is closed, the valve 164 will return to its previous position wherein port B is connected to plugged port D, and wherein the return line of cylinder 205 is connected through ports A-C to atmosphere. Accordingly, low pressure in line 202 will again retract cylinder 205.

Cylinder 206 corresponds to the rotator actuating cylinder 255 in FIG. 6, and is similarly normally held retracted by low pressure from line 202. When the two normally open contacts of the rotator check switch 109 are closed (see switch 243 in FIG. 7), however, and when the rotator start switch 117 is also closed, the rotator control valve 166 will reposition to extend cylinder 206, the same as with cylinder 205.

Cylinders 207-208 are the actuating mechanisms for the loader arms 30-31 depicted in FIG. 1, and are operated by the left and right loader arm control valves 168, 170, the same as with cylinders 203-204. Similarly, cylinders 209-210, which actuate the left and right unloader arms 49-50, are operated in the same manner by the left and right unloader control valves 194, 196, except that cylinders 209-210 are normally extended.

Cylinders 211-212 correspond to the two cylinders actuating the tie stop assemblies 55-56 in FIG. 8. As hereinbefore stated, the two tie stop assemblies 55-56 are intended to operate together, and thus both cylinders 211-212 are operated by a single tie stop control valve 184. Note in particular, however, that cylinders 211-212 are normally held extended by pressure from line 201, and that low pressure from line 202 will only retract the cylinders 211-212 when the valve is repositioned to couple port B with C, and port D with A.

Cylinders 213-214 correspond to the cylinders represented by cylinder 280 in FIG. 6, and are connected with valves 180, 182 to operate the same as cylinders 205-206. Cylinders 215-218 correspond to the two pair of short and long stroke cylinders 289-290 depicted in FIG. 4. More particularly, the left short stroke cylinder 215 is extended when valve 172 is positioned to couple ports B and C, and is retracted when the valve 172 is repositioned to couple ports B and D. The left long stroke cylinder 216, in turn, is similarly extended when valve 174 is positioned to couple ports B and C, and is retracted when port B is reconnected with port D in valve 174. Cylinders 217-218 are similarly operated by valves 176,178.

Cylinders 219-220, which correspond to cylinders 261-262 in FIG. 8, are independently operated by the left and right jogger control valves 186, 188, and are extended when ports B and C are connected. Cylinder 221 actuates the No. 2 flipper 75 in FIG. 4, and is actuated by valve 190 the same as valve 164 actuates cylinder 205. Cylinder 222 actuates the No. 3 flipper 68 in FIG. 1, and is controlled by valve 192 in the same manner.

The drag-off arms 65-66 and 70-71 are more correctly an operating part of a different portion of the sawmill, and are therefore not a part of the trimmer section per se. However, it should be noted that their operating cylinders (not depicted) and also the actuating cylinder (not depicted) in the stop assemblies 6 and 73, may be energized by pressure from line 201.

Referring now to FIGS. 10A–F, there may be seen a simplified schematic representation of circuitry suitable for operating the subject sawmill while in either the "automatic" mode, or while in the so-called "manual" mode. Inasmuch as the system is more characteristically described with respect to the "automatic" mode, the following description will be made on that assumption.

Referring again to FIG. 10A, the system may be seen to be actuated by high voltage power supply 100 which, in turn, is connected through a high voltage master switch 101 to the input side of a low voltage master switch 102 which, in turn, actuates a suitable low voltage power supply 103 having its output connected to a low voltage main conductor 103A. All components of the system are preferably driven by low voltage from the low voltage main 103, with the exception of the trimmer saw motors 42, 46, which are connected directly to the output side of the high voltage master switch 101. When a timber 5 impacts against the plate 7 in FIG. 1, this functions to close a limit switch 108 (which is located in the stop assembly 6) to connect low voltage power to the coil of the drag-off relay 224, whereupon power is then connected through the drag-off limit switches 106-107 (in the drag-off assemblies 8-9), and through the manual drag-off return switch 105, to provide a latching circuit for the relay 224. When the relay 224 is actuated, as hereinbefore described, power will now be connected from the low voltage main 103A through the solenoids 161, 163 through a complete circuit to ground or reference as represented by the circuit 245 in FIGS. 10A–F. Solenoids 161, 163 are the actuating units for the left and right drag-off valves 160, 162, and thus, the timber 5 will now be laterally transferred from the roller bed 3 to the deck assembly. Note that the deck actuator switch 110 will now be closed when the timber 5 depresses the pad-type switch 14 to actuate the deck motor 21. Thus, the deck motor 21 will now move the timber 5 along the trimmer deck assembly until the timber 5 clears the pad 14 to re-open the deck actuater switch 110.

As hereinbefore stated, this action will be repeated when the roller bed 3 delivers the next succeeding timber to the plate 7 of the stop assembly 6. It will be noted in this regard, that the deck motor 21 may also be selectively actuated by the operator, by closing switch 112, and that the drag-off assemblies 8-9 may be similarly actuated at anytime by the operator by means of switch 104. In this regard, it should also be noted that, in FIGS. 10A-F, those switches which are operated by the system are depicted in single dashed lines, whereas those switches which are in the control booth with the operator and which are utilized by the operator to selectively control individual component portions of the system are depicted in FIGS. 10A-F by double dashed lines.

It should be noted that the drag-off limit switches 106-107 are re-opened whenever the drag-off arms 8-9 are moved to their extreme extension, and that this breaks the latching circuit for the drag-off relay 224, whereby power is now disconnected from the solenoids 161,163. This may also be accomplished, however, by means of manual drag-off return switch 105, which is interconnected between the drag-off limit switches 106-107 and the drag-off relay 224.

When the deck actuator switch 110 (switch 84 in FIG. 2) is closed, voltage power will now be connected through circuit 112A, the normally closed contacts of the No. 1 flipper relay 225, and the normally closed contacts of the rotator relay 226, to energize the trimmer deck motor 111 (motor 21 in FIG. 1). After the chains 18, of the trimmer deck assembly, carry the timber 5 off of the switch 110, the switch 110 will re-open to break the circuit and de-energize the motor 11, as hereinbefore explained.

If the timber 5 is in a relatively erect position, as illustrated by timber 5B depicted in FIG. 2, this will permit the check switch 113 (switch 16 in FIG. 2) to close, whereby power will be connected from the circuit 103 through the No. 1 flipper return switches 115-116, to close the No. 1 flipper relay 225. Note that power also bypasses the check switch 113 to provide a latched circuit for the No. 1 flipper relay 225 after the check switch 113 is re-opened.

Low voltage power is now coupled from the circuit 103A to the solenoid 115 of the No. 1 flipper control valve 164, which thereupon actuates the No. 1 flipper 17 as hereinbefore described. Note that whenever the relay 225 is energized, this breaks the circuit to the trimmer deck motor 111. Note also that actuation of the No. 1 flipper 17 will open the No. 1 flipper return switch 116 (see switch 96 in FIG. 3) to break the latching circuit to the No. 1 flipper relay 225. Note further that the manual switch 114 may also be used to actuate the No. 1 flipper, and that it may be returned by means of the manual return switch 115.

It should be noted that actuation of the rotator check switch 109 will not condition the rotator 27, because power for the solenoid 167, which actuates the rotator valve 166, arrives by way of the left and right unloader end switches 157-158.

Accordingly, at the beginning of any operating sequence, whether automatic or manual, the operator must employ the rotator start switch 117 to connect power from circuits 103A, 117A and 109A to energize the rotator relay 226, whenever the first timber in the sequence moves to close the normally open contacts of the rotator check switch 109. This will then provide a latching circuit through the rotator return switch 118, circuit 103A, the rotator relay 226, circuit 119A the loader limit switches 119-120, circuit 233J and the first pair of contacts of the rotator relay 226, to connect power to the rotator check switch 109. Thereafter, actuation of the rotator check switch 109, by subsequently arriving timbers, will condition the rotator 27 as hereinbefore explained. Accordingly, whenever the rotator check switch 109 is closed, power will now be applied to the solenoid 167 of the rotator valve 166, by way of the saw-up safety relay 237. Note also that power is now disconnected from the trimmer deck motor 111, as hereinbefore explained.

When the loader turn-on limit switch 151 (switch 243 in FIG. 7) is closed, power is connected through the manual control relay 223, and circuit 233E, to actuate the loader relay 227. Power will also be coupled from circuit 103A through the saw-up safety relay 237, to the solenoids 169,171 of the left and right loader valves 168,170. A latching circuit will now be provided through circuit 233J, the loader limit switches 119,120, circuit 119A, the relay 226, the rotator return switch 118, and the low voltage main circuit 103A. When both loader limit switches 119, 120 are opened, the loader relay 227 will be de-energized and power from circuit 103A will then be coupled through the manual control relay 223, the loader limit switches 120,119, and through circuit 146A, to the coil of the unloader relay 239. A latching circuit for relay 239 will now be provided through circuit 103A, the unloader return switch 147, the tie stop relay 238, circuit 233L the unloader return limit switches 148,149, the primary selection relay 240, and through circuit 146A, to the coil of relay 239. Power may now be coupled from circuit 103A to the solenoids 195, 197 of the left and right unloader valves 194,196.

At this point in the operation, the initial stage of the automatic sequence is complete since the timber 5D is now gripped between the tooth members 51-52 and the two tie stops 55,56, as shown in FIG. 4-5, and since the trimmer saws are manually actuated as previously explained. Accordingly, if the unloader return switch 147 is now opened, this will break the holding circuit for relay 239 to de-energize the solenoids 195, 197, and this will relax and restore the unloaders 49,50, to disengage the timber 5D, to permit use of the No. 2 flipper 75, if desired, and to also permit use of the joggers 57,58.

Power may now be connected from Circuit 103A, through the last contacts of relay 239, circuit 239H, to the No. 2 flipper switch 125, and to the jog left and right switches 123-124. When switch 125 is closed, power will be coupled through relay 237 to the solenoid 191 of the No. 2 flipper valve 190. Similarly, when switches 123-124 are closed, power will be applied to solenoids 187, 189, respectively, to actuate the jog left and right valves 186-188. After the timber 5D has been repositioned as desired, however, the unloader start switch 146 may be closed to cause the timber 5D to be reengaged between the tooth members 51-52 and the two tie stops 55-56, whereby the timber 5D may now be trimmed as previously explained.

When both unloader end switches 157-158 are closed, power will be connected from circuit 103A to the coil of the unloader safety relay 242. Now, if the left saw-up switch 138 is closed, power will now be coupled from circuits 103A, 139A, and 242D, to energize the left saw-up relay 234, whereupon power will then be coupled from circuit 103A to the solenoid 181 of the left saw lift valve 180. Note that power is also coupled through the relay 234 to circuit 234A, the left saw-up limit switch 142, the left saw-down control switch 141, and circuit 139A, as a holding circuit for relay 234.

The limit switch 142 is intended to provide for cutting only timbers of less than a predetermined size. If the left saw-up switch 138 is held closed while the limit switch 142 opens, however, the saw will ride past the limit switch 142 until it reaches its maximum elevation as hereinbefore explained. To return the left saw, it is then necessary to open the left saw-down switch 141.

If the both-saws-up switch 140 is closed, this will energize the both-saws-up relay 236, whereby power will be coupled through relay 242 and circuit 242D, to energize and latch the relay 234. Similarly, power is coupled through circuit 242A to energize and latch relay 235, and solenoids 181,183 will now both be actuated. Note that if switch 140 is held closed, this will override both limit switches 142,144 as hereinabove explained, and both switches 141,143 will then be required to restore both saws.

When the selection control circuit 246 is actuated as hereinafter explained, this will couple power from circuit 103A, secondary selection relay 241, circuit 241B, through relay 237, circuit 237P, switch 246 to energize the primary selection relay 240. The latching circuit to the unloader relay 239 has now been broken to release the timber 5D, whereupon the unloader end switches 157-158 will be reclosed to again energize the unloader safety relay 242. Power will now be applied from circuit 103A through relay 240 and circuit 242H to energize the tie stop relay 238. This, in turn, couples power from circuit 103A to the solenoid 185, to energize the tie stops valve 184 to lower the tie stops 55-56.

When the tie stops 55-56 reach their lower position, the left and right stops-down limit switches 154-155 will be closed, whereby power from circuit 103A will be coupled through relay 240 and circuit 237J, through relay 238 and circuit 146A, to re-energize the unloader relay 239. The unloader assemblies 49-50 will now be energized to carry the trimmed timber onto the second roller bed assembly 61, as hereinbefore described, and also to close the unloader return limit switches 148-149. This, in turn, will now couple power from circuit 103A through circuit 148A and relay 240 to actuate the secondary selection relay 241 in the selection control circuit 246, as will also be hereinafter explained.

The circuit actuating the primary selection relay 240 is now broken, the relay 238 is released, and the relay 239 is then released. In addition, power will now be coupled from circuit 103A through circuit 148A and switches 148-149, circuit 233M, and through relay 223 and, if the rotator check switch 109 is closed, through circuit 109A to energize the rotator relay 226. The rotator will again be actuated as hereinbefore explained, and the first stage of the automatic sequence will then be repeated.

Figure 11A:
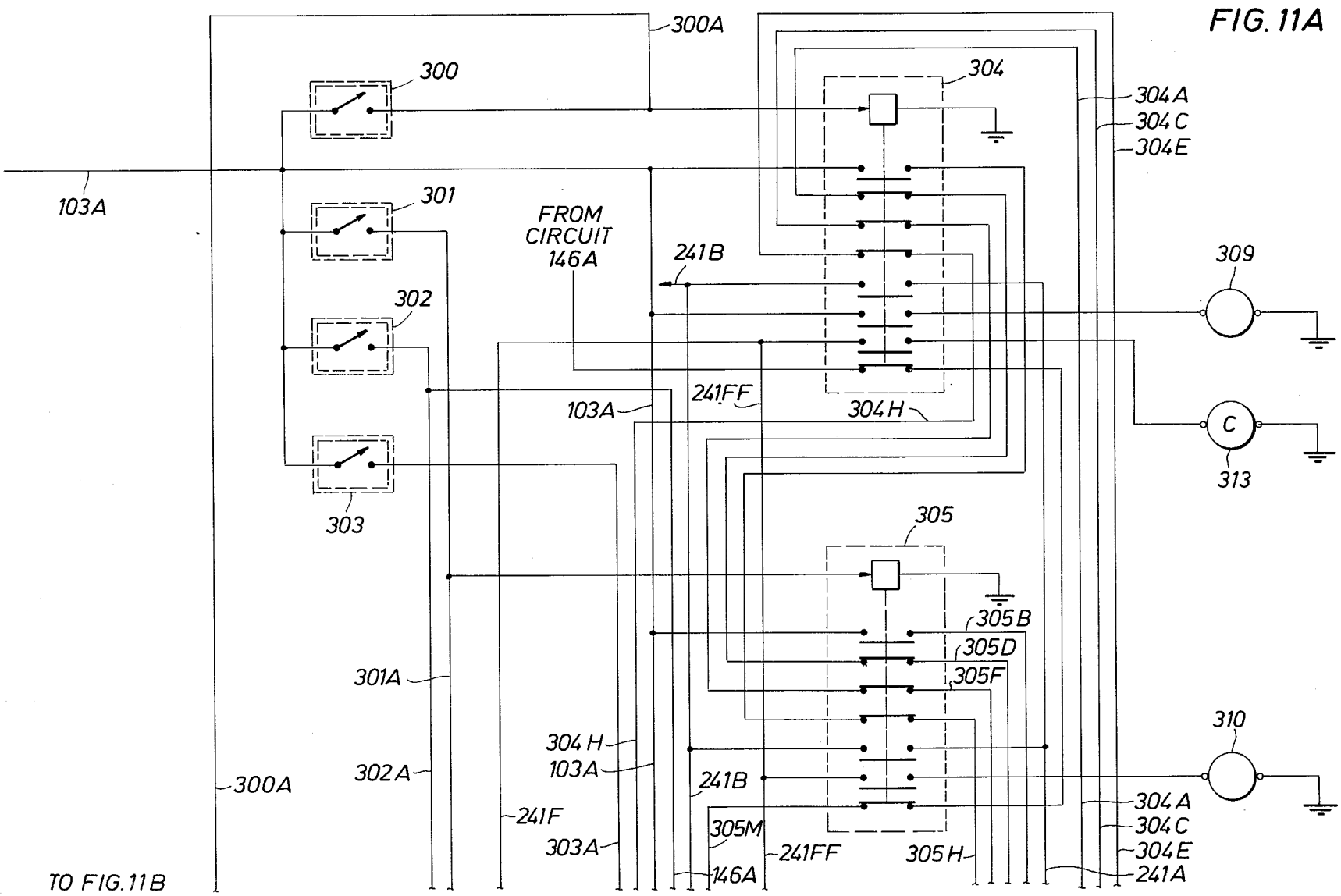
Figure 11B:
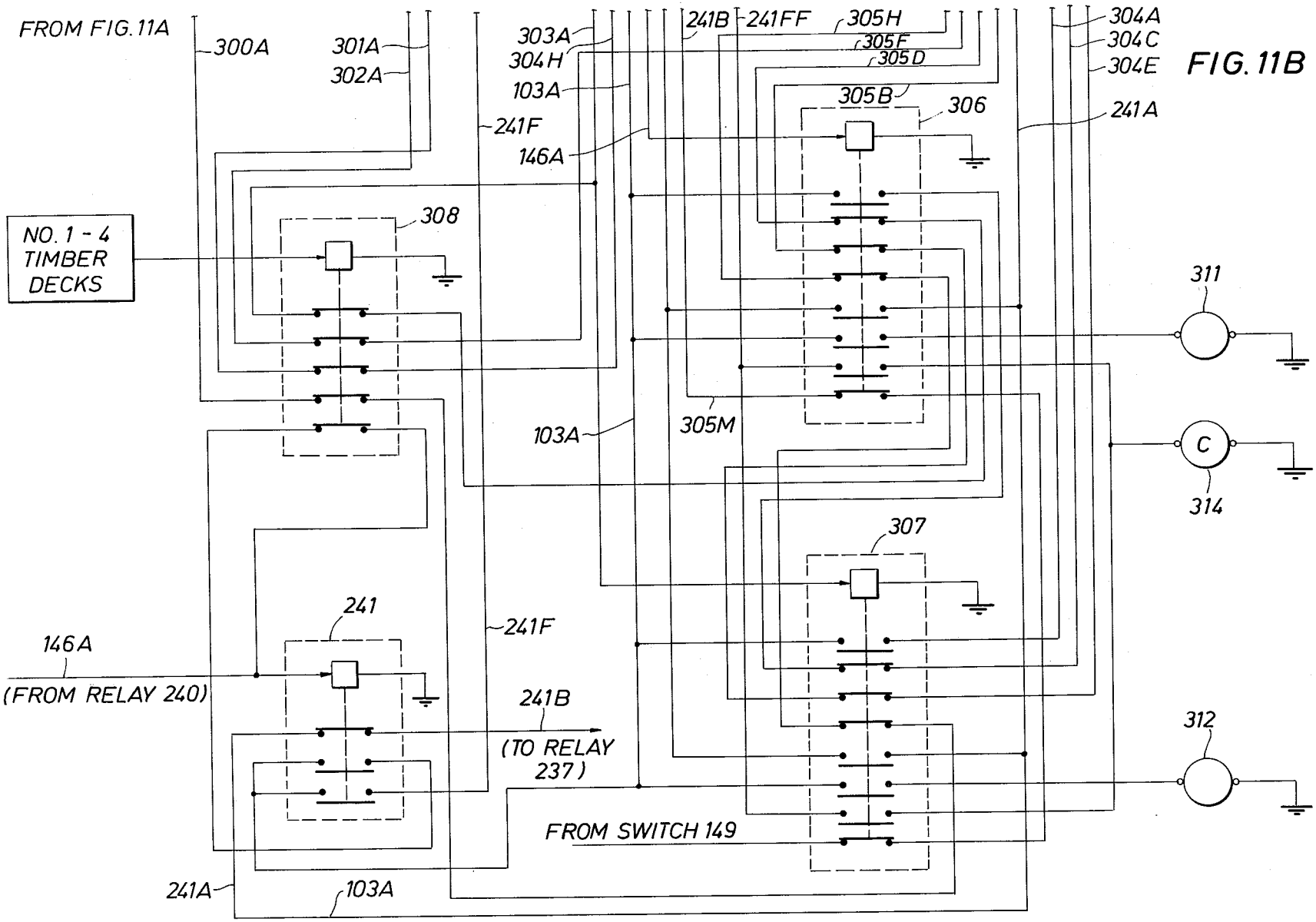

The operation of the system will now be described with respect to the circuitry depicted in FIGS. 11A–B. To summarize, the operation of this system, while in the automatic mode, may be simply stated in terms of the following steps. In the first step, a timber is carried by the first roller bed section 3 until it impacts the stop plate 7, thereby closing switch 108. In step two, the drag-off assemblies 8-9 are actuated by switch 108 to transfer the timber from the first roller bed section 3 onto the pad assembly 14, to thereby close switch 84 (switch 110). Closure of switch 84 will actuate the trimmer deck motor 21 to thereby carry the timber forward until it clears the pad assembly 14 and releases the switch 84 (switch 110), whereupon the trimmer deck motor 21 is inactivated. If the timber is in erect position whereby it deflects pendulum 88, switch 16 will cause the cylinder 91 to be energized, whereupon the No. 1 flipper rises to rotate the timber, and, coincidentally, actuates switch 96. Closure of switch 96 de-activates the cylinder 91, to restore the No. 1 flipper to its original retracted position. (When switch 84 actuates cylinder 91, it should be noted that this also inactivates the trimmer deck motor 21.).

The next step of the operation will occur when the trimmer deck motor 21 eventually carries the timber onto the rotator 29, to activate the switch 293. This inactivates the trimmer deck motor 21 and also conditions the rotator 29 to operate if (a) the operator closes the rotator start switch 117, or (b) the unloader assemblies 49-50 extend to their maximum travel to close switches 148-149 while transferring a trimmed tie or timber onto the second roller deck 61. Upon the occurrence of either of these alternatives, the rotator 29 will revolve to transfer the timber off of switch 293 and onto the loader arms 30-31. Note that the trimmer deck motor 21 is also disabled whenever the rotator 29 moves out of its normal position.

When the rotator 29 reaches its full revolution to drop the timber onto the loader assemblies 30-31, this also closes switch 243 to cause the loader assemblies 30-31 to shift the timber onto the unloader assemblies 49-50, and also to activate limit switches 119-120 upon reaching maximum extension. When the loader limit switches 119-120 are actuated, this causes the loader assemblies 30-31 to return to their original position, and further causes the unloader assemblies 49-50 to drag the timber into locking engagement with the two tie stops 55-56. In addition, this will also cause the rotator 29 to be revolved to its normal position to accept the next succeeding timber from the trimmer deck assembly, and also to re-enable the trimmer motor 21 to be actuated as hereinbefore described.

This concludes the first stage of the operation. Note that the second stage of the operation cannot begin unless the trimmer saws 38-39 are in a lowered position to actuate the saw-down switches 276.

The operator may now trim the ends of the ties by means of either switch 138, 139 or 140. In either case, this is done manually. The operator may also, at that time, designate which of the various timber deck assemblies to receive the timber then being trimmed, by selecting and closing the appropriate one of switches 300-303 in the control circuit 246. It should be noted that this may be done either before, or after, the trimmer saw blades 38-39 are returned to their normal position, since nothing can be actuated as long as the saw-down switch 276 (and its counter-part switch) is in a relaxed positon.

It should be noted that, if the operator waits until switch 276 is re-activated, then the selection stage will commence whenever one of the deck selection switches 300-303 is closed. Alternatively, if the operator does not wait to close the selected one of the deck selection switches 300-303, then the selection stage will be commenced upon the two saw blades 38-39 being returned to their normal position, and upon the actuation of switch 276 and its counterpart. On the other hand, the operator need not perform the trimming operation if unnecessary. In such a case, if he closes an appropriate one of the deck selection switches 300-303 before closing one of his saw switches 138-140, and while the switch 276 and its counterpart are both actuated, then the following stage of the automatic mode will be initiated at that point.

The second stage of the automatic mode sequence will commence whenever the operator chooses and closes one of the deck selection switches 300-303 as hereinbefore described with respect to the three alternative sequences. In this case, the unloader assemblies 49-50 will relax their grip upon the timber, and will return to their original positions, whereupon their end switches 157-158 will then be closed to cause the tie stop assemblies 55-56 to retract. In addition, it should be noted that closing the No. 1 deck selection switch 300 will cause the stop assembly (not depicted), which is located in the second roller bed assembly 62 for the purpose of regulating input into the first timber deck assembly 64, to be elevated. On the other hand, if the No. 2 deck selection switch 301 has been closed, nothing more will happen at this time. Alternatively, if the No. 3 deck selection switch 302 has been closed, the stop assembly (not depicted) which regulates input into the third timber deck (not depicted) will be elevated. On the other hand, if the No. 4 deck selection switch 303 has been actuated, this would elevate the stop assembly (not depicted) which is intended to serve the fourth tie deck assembly (also not depicted).

When the various tie stops are lowered, they will engage and actuate switches 154-155, whereupon their appropriate unloader assemblies will then respond to shift the timber onto the second roller deck assembly 61. It should be noted, therefore, that when such unloader assemblies reach full extension, the following sequence will occur. The first stage of the automatic sequence will again be initiated as hereinbefore explained, and the various tie stops in the second roller deck assembly 61 will already be in their original elevated positions. In addition, the unloader assemblies will return to their retracted positions.

In addition to the foregoing, one of the following alternatives will also occur. If the No. 1 deck selection switch 300 has been closed, then the "run left" motor control 313 will be actuated to cause the second roller deck assembly 61 to carry the timber resting thereon until it reaches the tie stop (not depicted) in front of the No. 1 timber deck. Impact with the tie stop will, of course, cause the drag-off arms connecting with such timber deck assembly to carry the timber off of the roller bed 61 and onto the tie stacker associated therewith (not depicted), all as hereinbefore described. If the No. 2 deck selection switch 301 has been closed, however, then the No. 2 drag-off arms 65-66 will be activated only, whereby the timber is removed from the roller deck assembly 61 and shifted onto the tie stacker arms 67 associated therewith. If, on the other hand, the No. 3 deck selection switch 302 has been closed, then the "run right" motor control 314 will be actuated to cause the roller deck assembly 61 to carry the timber into engagement with the No. 3 tie stop assembly 73, which, in turn, activates the No. 3 drag-off arms 70-71. Note that the timber will also be shifted onto the tie stacker arms 72 associated therewith. In the fourth alternative, and if the No. 4 deck selection switch 303 has been activated, then the operation will be the same as when the No. 3 deck selection switch 302 was closed, except that the roller deck assembly 61 will carry the timber until it impacts against the tie stop assembly (not depicted) which is associated with the fourth tie deck assembly (also not depicted).

Whenever the drag-off arms for any of the various timber decks are activated, this will produce a low voltage signal to actuate the selection kill relay 308, whereupon the selection control circuit 246 will return to its original condition, and whereupon any elevated stop assembly in the second roller deck assembly 61 will be retracted. Also, the roller deck assembly 61 will then be inactivated, if it is running at that time. Note, however, that the drag-off arms in these various timber deck assemblies are independent of the selection control circuit 246, however, and that they will follow their own sequences.

It will be noted that the saw blades 38-39 are movable laterally as well as horizontally, in order to provide means whereby the ties may be trimmed to different preselected lengths. The blades are normally in what is known as position 1, which is the position of closest spacing and which is usually eight feet. Each may be moved in six inch increments, and therefore, when the left saw blade 39 is moved to position 2, the spacing between the blades will be eight and one-half feet. Consequently, when the left saw blade 39 is moved to position 3, the spacing will be nine feet, and when the left saw blade 39 is moved to position 4, the spacing between blades will be a total of nine and one-half feet. The right saw blade 38 being still in position 1, of course. Accordingly, it will thus be apparent that when the blades are spaced a maximum distance apart, the spacing will be a total of eleven feet.

Inasmuch as the blades are selectively and individually spaced along the axis, this permits variation of the cutting positions of the two blades with respect to the trimmer, as well as variation of the spacing between the two blades. This feature of the apparatus permits the blades to be positioned so as to accommodate a timber which is somewhat off center along the unloader arms 49-50, and avoids the necessity of using the jogger assemblies in every instance.

Referring again to FIGS. 10A–F, it will be seen that positioning of the two saw blades may be accomplished by means of the following procedure.

The left saw blade is normally positioned at position 1 as represented by normally closed left saw position 1 control switch 129. To move the left saw blade 39 to position 2, the operator will close the left saw position 2 switch 128, thereby connecting power from low voltage main conductor 103A to the solenoid of the left saw position 1 relay 228. This provides a latching circuit for relay 228, by connecting power from the low voltage conductor 103A through the normally closed contacts of the left saw position 3 relay 230 and the normally closed contacts of the left saw position 2 relay 229, to the solenoid of the left saw position 1 relay 228. Power will now be connected to the solenoid 173, of the left inside saw shift valve, thereby moving the saw to the position selected.

If it is desired to move the left saw blade 39 to position 3, this is effected by closing the left saw blade position 3 switch 127, thereby connecting power from the low voltage conductor 103A to the solenoid of the left saw position 2 relay 229, thereby closing this component. A latching circuit is now provided because the left saw position 1 relay 228 has been opened. In particular, left saw position 1 switch 129, which connects power from the low voltage main circuit 103A through the now latched contacts of relay 229 and the normally closed contacts of relay 230, to reach the solenoid of relay 229. Solenoid 173 has been inactivated, but solenoid 175 is now energized to move the saw blade accordingly.

If it is desired to move the left saw blade 39 to the outermost position 4, this may be accomplished by closing left saw position 4 switch 126 to connect power to the solenoid of the left saw shift position 3 relay 230. A latching circuit for relay 23 will now be provided by coupling power from the low voltage main circuit 103A, through the left saw position 1 switch 129, the normally closed contacts of the left saw shift position 1 relay 228, the now closed contacts of the left saw shift position 3 relay 230, the normally closed contacts of the now re-opened left saw shift position relay 229, to the coil of the left saw shift position 3 relay 230. It will now be seen that the left saw blade 39 will be shifted to the maximum outermost position due to activation of both solenoids 173 and 175.

The left saw blade 39 may be returned to its original or No. 1 position, by merely opening the normally closed left saw position 1 switch 129. When this is done, this breaks whatever latching circuit may have been previously established with respect to any one of relays 228-230, whereupon these components will return to their normal position, and whereupon power will be discontinued from either one or both of the solenoids 173 and 175.

As hereinbefore explained, it is not necessary to position the left saw blade 39 according to any particular sequence, and therefore, the foregoing description was intended for illustration purposes only. In actuality, the left saw blade 39 may be positioned to any position, from any position, as may be desired by the operator. In other words, if it is desired to move the left saw blade to position 2, all that is required is that the operator actuate the left saw position 2 switch 128.

The right saw blade 38 may be moved in precisely the same manner, and by means of precisely the same type of components. In other words, the right saw position 1 switch 130 corresponds functionally to the left saw position 1 switch 129, and the right saw position 2 switch 131 corresponds functionally to the left saw position 2 switch 128. Similarly, the right saw position 3 switch 132 corresponds functionally to the left saw position 3 switch 127, and the right saw position 4 switch 133 corresponds functionally to the left saw position 4 switch 126.

The right inside saw shift solenoid 177, which actuates the right inside saw shift valve 176, corresponds functionally to the left inside saw shift solenoid 173. Likewise, the right outside saw shift solenoid 179 which actuates the right outside saw shift valve 178, corresponds functionally to the left outside saw shift solenoid 175. In addition, the right saw shift position 1 relay 231 corresponds functionally to the left saw shift position 1 relay 228, and the right saw shift position 2 relay 232 corresponds to the left saw shift position 2 relay 229. Likewise, the right saw shift position 3 relay 233 corresponds to the left saw shift position 3 relay 230.

Referring again to FIGS. 10A-F, it will be noted that the No. 3 flipper switch 150 may be closed to connect power from the low voltage circuit 103A to the solenoid 193 which, in turn, actuates the No. 3 flipper valve 192. In addition, the trimmer stops valve control switch 145 may be used by the operator to connect power from the low voltage main circuit 103A through the normally closed contacts of the unloader safety relay 242 to the solenoid of the tie stop relay 238. When this component is actuated, this couples power from the low voltage and main circuit 103A to the tie stops valve solenoid 185, to actuate the tie stops valve 184. This, in turn, lowers both tie stops accordingly. The right saw-up control switch 138 corresponds functionally to the left saw-up control switch 139, by permitting the operator to couple the power from the low voltage control circuit 103A through the normally closed contacts of the unloader safety relay 242 to the solenoid of the tie stop relay 238, all as hereinbefore explained. The function of the manual No. 1 flipper control switch 114 is to couple voltage power from the circuit 103A to actuate the No. 1 flipper relay 225.

As hereinbefore stated, the circuitry depicted in FIGS. 10A-F will show that the system is normally within the so-called automatic mode. If it is desired to go to the manual mode, the operator will close the manual control switch 159, thereby connecting power from the low voltage main circuit 103A to the solenoid of the manual control relay 223. It will be noted that, since the automatic control switch 176 is normally closed, this provides a latching circuit to hold the manual control relay 223 in an energized condition, even after the manual control switch 159 has been released by the operator.

When the manual control relay 223 has been energized, as hereinbefore explained, low voltage power will be connected from the low voltage circuit 103A to the input side of the two deck actuator switches 110, 112. As hereinbefore explained, whenever the rotator deck switch 109 is positioned by the presence of a timber, the the trimmer deck is supposed to be inactivated. When the system is in the manual mode, however, the deck actuator control switch 112 may now be closed to energize the trimmer deck notwithstanding. A further effect is that the loader turn-on limit switch 151 will now be disconnected from its source of power, thereby preventing the loaders 30,31 from being inadvertently activated. In addition, power is now disconnected from both the left and right loader limit switches 119, 120, thereby prohibiting the unloaders 59, 60 from being actuated, and also preventing the loaders 30, 31 and the rotator 29, from returning to their original positions.

As hereinbefore stated, it is a feature of this apparatus that the tie is fixedly clamped in position before and during the trimming operation in order that this function may be performed with safety to personnel in the area. Referring again to FIGS. 10A-F, it will be seen that this function is performed by the saw-up safety relay 237 in conjunction with the left and right saw-down limit switches 152-153. These two switches are normally closed, but they are held open by the position of the respective ones of the two saw blades 38-39 being in their lowered positions. When either or both of these two saw blades 38-39 are lifted from their lowered positions, however, this will release one or both of the left and right saw-down switches 152-153, thereby coupling power from the low voltage main circuit 103A to the solenoid of the saw-up safety relay 237, as hereinbefore explained. When the saw-up relay 237 is actuated, this disconnects power from the solenoids 187,189 of the jog left and jog right valves 186,188, and also from the solenoid 191 of the No. 2 flipper valve 190. In addition, power will now be connected to the solenoids 195, 197 of the left and right unloader valves 194, 196, thereby preventing the left and right unloaders 59,60 from being actuated to release their grip upon the timber then being subjected to cutting by the rising timber blades 38-39. In addition to the foregoing, it will be noted that power is also disconnected from the solenoid 67 of the rotator valve 166, and also from the solenoids 169, 167 of the left and right loader valves 168, 170. In addition, it will be noted that the energized position of the saw-up safety relay 237 also prevents the primary selection relay 240 from being energized. The purpose of this feature is to permit the operator to select the appropriate tie deck to receive the timber being trimmed, even before the trimming operation has been completed, as hereinbefore mentioned.

Referring again to FIGS. 10A–F, it should be noted that the trimmer deck assembly may be selectively activated by the deck actuator manual switch 112. Note also that the rotator return switch 118 corresponds to switch 243 in FIG. 7. See also the loader manual return and start switches 121, 122, which are used to selectively activate the loaders 30, 31, and the left and right saw on-off switches 134, 135 which are used to activate the left and right saw motors 136, 137. See also the trimmer stops down switch 145 in FIGS. 10A–F, which corresponds to the switch 271 depicted in FIG. 6.

It will be apparent from the foregoing that many other variations and modifications may be made in the structures and methods described herein without substantially departing from the essential concept of the present invention. Accordingly, it should be clearly understood that the forms of the invention described herein and depicted in the accompanying drawings, are exemplary only and are not intended as limitations in the scope of the present agreement.

What is claimed is:

1. A method of routing timbers in a sawmill and the like, comprising conducting a plurality of timbers sequentially and longitudinally along a first path in said sawmill to a first transfer location, laterally shifting a first one of said timbers from said first transfer location onto a second path extending therefrom to a second transfer location, laterally shifting a second one of said timbers from said first transfer location onto said second path behind said first timber thereon, laterally moving said first timber along said second path to said second transfer location, arcuately and laterally shifting said first timber from said second transfer location to a trimming location while laterally moving said second timber to said second transfer location, laterally shifting said first timber from said trimming location to a third transfer location along a third path leading to a plurality of receiving location, arcuately and laterally shifting said second timber from said second transfer location to said trimmer location in response to said shifting of said first timber to said third transfer location, and shifting said first timber from said third transfer location along said third path to a selected one of said receiving locations.

2. In a sawmill having a first path extending along a first transfer location and a plurality of receiving stations, a second path extending from a second transfer location to said first transfer location in said first path, and a trimmer location spaced in said second path from said first transfer location, the method of routing timbers in said sawmill to selected ones of said receiving stations comprising the steps of establishing a first timber at said trimming location and a second timber at said second transfer location, selecting one of said receiving stations for said first timber, shifting said first timber from said trimmer location to said first transfer location and thereafter to said one receiving station as a function of said selecting step while shifting said second timber from said second transfer location to said trimmer location as a function of said shifting of said first timber to said first transfer location in said sawmill, said second timber being established at said transfer location by the steps of conducting said second timber longitudinally along a third path intersecting said second path at a third transfer location, laterally shifting said second timber from said third path at said third transfer location to said second path, and laterally traveling said second timber along said second path from said third transfer location to said second transfer location, said second timber being laterally travelled a preselected distance along said second path upon being shifted thereto from said third path, conducting a third timber longitudinally along said third path behind said second timber, stopping said third timber in said third path in response to shifting said second timber from said third path to said second path and thereafter conducting said third timber to said third location, and laterally shifting said third timber from said third path to said second path for travel at a distance behind said second timber functionally related to said preselected travel distance of said second timber.

3. The method described in claim 2, further including examining the vertical position of said second timber during travel through said preselected distance along said second path, and revolving said second timber during such travel.

4. The method described in claim 3, wherein said second timber is shifted from said second transfer location to said trimmer location through an arc of substantially 90 degrees.

5. A sawmill trimming and routing assembly and the like comprising first conveyor means for transferring a timber from a first location to a second location, means for moving said timber from said second location to a second conveyor means, means responsive to the movement of said timber for actuating said second conveyor means, means cooperating with said second conveyor means for selectively flipping said timber, means cooperating with said second conveyor for rotating said timber from a first position to a second position, loader means for moving said timber from said second position to a third stationary position, means for selectively laterally shifting said timber, a saw assembly for trimming the ends of said timber and including at least two rotatable saw blades, means for laterally shifting the position of each of said saw blades, and means for transferring said trimmed timber to a third conveyor means.

6. The assembly described in claim 5, and wherein said means for flipping includes a toothed engaging member and means for driving said engaging member upwardly with respect to said second conveyor means.

7. the assembly described in claim 5, wherein said means for rotating includes at least two notched members and means for driving said members between first and second positions.

8. The assembly described in claim 5, wherein said timber shifting means includes at least two laterally movable claw-like members and means for actuating said claw-like members independently one of the other.

9. The assembly described in claim 5, wherein said saw assembly includes drive means for rotating said saw blades, means for pivotally mounting said saw blades, and means for raising said saw blades independently one of the other.

10. The assembly described in claim 9, wherein said saw blade shifting means includes first and second plate assemblies, the drive means for each blade being located on one of said plate assemblies respectively, each saw blade being carried by one of said plate assemblies respectively, and means for laterally shifting each of said plate assemblies.

11. A sawmill trimming and routing assembly and the like comprising first conveyor means for transferring a timber from a first location to a second location, means for moving said timber from said second location to a second conveyor means, means cooperating with said second conveyor means for selectively flipping said timber, means cooperating with said second conveyor for rotating said timber from a first position to a second position, loader means for moving said timber from said second position to a third stationary position, means for selectively laterally shifting said timber, a saw assembly for trimming the ends of said timber and including at least two rotatable saw blades, and means for transferring said trimmed timber to a third conveyor means.

12. The assembly described in claim 11, and wherein said means for flipping includes a toothed engaging member and means for driving said engaging member upwardly with respect to said conveyor means.

13. The assembly described in claim 11, wherein said means for rotating includes at least two notched members and means for driving said members between first and second positions.

14. The assembly described in claim 11, wherein said timber shifting means includes at least two laterally movable claw-like members, and means for actuating said claw-like members independently one of the other.

15. The assembly described in claim 11, wherein said saw assembly includes drive means for rotating said saw blades, means for pivotally mounting said saw blades, and means for raising said saw blades independently one of the other.

16. A sawmill trimming and routing assembly and the like comprising first conveyor means for transferring a timber from a first location to a second location, means for moving said timber from said second location to a second conveyor means, meand cooperating with said second conveyor means for selectively flipping said timber, means cooperating with said second conveyor for rotating said timber from a first position to a second position, loader means for moving said timber from said second position to a third stationary position, a saw assembly for trimming the ends of said timber and including at least two rotatable saw blades, and means for transferring said trimmed timber to a third conveyor means.

17. The assembly described in claim 16, and wherein said means for flipping includes a toothed engaging member and means for driving said engaging member upwardly with respect to said second conveyor means.

18. The assembly described in claim 16, wherein said means for rotating includes at least two notched members and means for driving said members between first and second positions.

19. The assembly described in claim 16, wherein said saw assembly includes drive means for rotating said saw blades, means for pivotally mounting said saw blades, and means for raising said saw blades independently one of the other.

20. A sawmill trimming and routing assembly and the like comprising first conveyor means for transferring a timbr from a first location to a second location, means for moving said timber from said second location to a second conveyor means, means cooperating with said second conveyor for rotating said timber from a first position to a second position, loader means for moving said timber from said second position to a third stationary position, a saw assembly for trimming the ends of said timber and including at least two rotatable saw blades, and means for transferring said trimmed timber to a third conveyor means.

21. The assembly described in claim 20, wherein said means for rotating includes at least two notched members and means for driving said members between first and second positions.

22. The assembly described in claim 20, wherein said saw assembly includes drive means for rotating said saw blades, means for pivotally mounting said saw blades, and means for raising said saw blades independently one of the other.

23. A trimmer saw assembly and the like comprising a plate assembly having driving means positioned thereon, means for pivotally mounting one end of said plate assembly, means for raising and lowering the other end of said plate assembly, said other end including a rotatable drive shaft connected to said driving means and a saw blade rotatable by said shaft, means for laterally shifting said plate assembly including a stationary positioning blade, and a notched positioning bar connected to said other end of the plate assembly and cooperating with said positioning blade when said plate assembly is shifted.

* * * * *